United States Patent [19]

Aoki et al.

[11] Patent Number: 5,038,148

[45] Date of Patent: Aug. 6, 1991

[54] CONTROL DATA TRANSFER SYSTEM FOR PHASE SHIFTERS IN ANTENNA

[75] Inventors: Toshihiko Aoki; Susumu Hishinuma; Nobutake Orime, all of Kanagawa, Japan

[73] Assignee: Mitsubishi Denki Kabushiki Kaisha, Tokyo, Japan

[21] Appl. No.: 534,178

[22] Filed: Jun. 6, 1990

[30] Foreign Application Priority Data

Jun. 7, 1989 [JP] Japan ..... 1-144737

[51] Int. Cl.[5] ..... H01Q 3/22

[52] U.S. Cl. ..... 342/372; 342/375; 342/377

[58] Field of Search ..... 342/371, 372, 374, 375, 342/377; 328/155

[56] References Cited

U.S. PATENT DOCUMENTS 4,445,119 4/1984 Works ..... 342/377
4,688,045 8/1987 Knudsen ..... 342/377
4,749,995 6/1988 Hopwood et al. ..... 342/371
4,922,257 5/1990 Saito et al. ..... 342/377
4,994,814 2/1991 Aoki et al. ..... 342/372

FOREIGN PATENT DOCUMENTS 103342 4/1989 Japan .

*Primary Examiner*—Thomas H. Tarcza
*Assistant Examiner*—Tod Swann
*Attorney, Agent, or Firm*—Wolf, Greenfield & Sacks

[57] ABSTRACT

An antenna control data transfer system having antenna elements, phase shifters changing the phase of electromagnetic waves transmitted or received by the antenna elements, and phase shifter control circuits controlling the phase shifters, wherein each of the phase shifter control circuits includes an address holding circuit storing an address for identifying the phase shifter control circuit, a data input circuit for receiving data, and a data output control circuit for selectively outputting the received data or inhibiting the data output in accordance with a control signal from a signal processor.

27 Claims, 21 Drawing Sheets

CONTROL DATA TRANSFER SYSTEM FOR PHASE SHIFTERS IN ANTENNA

BACKGROUND OF THE INVENTION

1. Field of the Invention

This invention relates to a system for transferring antenna control data to a control circuit for a phase shifter in each of the antenna elements.

2. Description of the Prior Art

FIG. 1 is a schematic representation of the arrangement of a conventional system for transferring antenna control data, which comprises, as shown antenna elements (apertures) 1*a*–1*d* for transmitting or receiving electromagnetic waves, duplexers 2*a*–2*d* for transmitting the antenna elements for alternate use for transmitting and receiving electromagnetic waves to and from the antenna elements 1*a*–1*d*, respectively, a duplexer control signal line 3 for feeding a duplexing signal to the duplexers 2*a*–2*d*, and phase shifters 4*a*–4*d* for shifting the phase of the electromagnetic waves to be transmitted or received by the antenna elements 1*a*–1*d*, respectively. The system shown in FIG. 1 further includes phase shifter control circuits 5*a*–5*d* for controlling the amount of phase shift of the electromagnetic waves given by the phase shifters 4*a*–4*d*, respectively, a data line 14 for transferring data for controlling the phase shifters 4*a*–4*d* to each of the phase shifter control circuits 5*a*–5*d*, a clock line 15 for carrying a clock which serves as a trigger signal for each of the circuits 5*a*–5*d* when it performs processing operations such as latching the data transmitted from the data line 14, a reset line 16 for transferring a reset signal for resetting each of the circuits 5*a*–5*d*, X-enable lines 29*a* and 29*b* commonly connected to such ones of the circuits 5*a*–5*d* as positioned in the same X-row, and Y-enable lines 30*a*–30*b* commonly connected to such ones of the circuits 5*a*–5*d* as positioned in the same Y-row.

FIG. 2 is a schematic representation of the arrangement of the exemplary circuit 5 of the phase shifter control circuits 5*a*–5*d* of the antenna control data transfer system shown in FIG. 1. The circuit 5 comprises a phase data holding circuit 6 for holding the phase data or the amount of phase shift of the electromagnetic waves given by the associated phase shifter 4, a signal processing circuit 7 for performing signal processing operation in accordance with the data from the data line 14, a coordinate holding circuit 9 for holding the coordinates of associated ones of the antenna elements 1*a*–1*d*, a phase factor holding circuit 10 for holding a phase factor to be used when the signal processing circuit 7 computes the amount of phase shift of the electromagnetic waves in accordance with the data from the data line 14, and a correction data holding circuit 11 for holding a correction data for compensating the computed value for error caused by variations in electrical length of the transmission of the electromagnetic waves to the respective antenna elements, etc.

In operation, the phase of an electromagnetic wave transmitted or received by each of antenna elements 1*a*–1*d* is set according to the following Equation (1) so that the whole set of antenna elements 1*a*–1*d* may transmit or receive a beam of electromagnetic waves in a desired direction:

$$\phi_n = k \times (P_n \cdot D) + C_n \qquad (1)$$

where n=a, b, c, d;

$\phi n$ is the phase data or the amount of phase shift of an electromagnetic wave transmitted or received by the antenna element 1*n*;

$P_n$ is the position vector of the antenna element 1*n*, the components of $P_n$ representing the coordinates of the antenna element 1*n*;

and D is a unit direction vector in a desired beam direction.

Thus, $P_n \cdot D$ is the inner product of two vectors $P_n$ and D. Further, k is a phase factor depending upon the electromagnetic wave frequency; and $C_n$ is a correction data for compensating the computed value for the error caused by variation in electrical length of the transmission of the electromagnetic waves to the antenna element 1*n*, etc.

In order to set the beam of electromagnetic waves in a desired direction, the data of the respective components of the unit direction vector D in the desired direction is transferred through the data line 14 to each of the phase shifter control circuits 5*a*–5*d*. When each of the circuits 5*a*–5*d* has received that data, the signal processing circuit 7 therein computes the phase data or the amount of phase shift of the electromagnetic waves in accordance with Equation (1) using the received respective components of the unit direction vector D in the desired beam direction, the coordinates of each of the antenna elements 1*a*–1*d*, i.e., the respective components of the position vector $P_n$ of each of the antenna elements, fetched from the associated coordinate holding circuit 9, the phase factor k fetched from the associated phase factor holding circuit 10 and the correction data fetched from the associated correction data holding circuit 11 for correcting the error in the computed value caused by variation in electrical length of the transmission of the electromagnetic waves to each of the antenna elements 1*a*–1*d*, and then feed the derived phase data to the phase data holding circuit 6. The phase data holding circuit 6 temporarily stores the fed phase data and also supplies it to an associated one of the phase shifters 4*a*–4*d*. The phase shifters 4*a*–4*d* operates in response to the phase data to shift the phase of the electromagnetic waves to be transmitted or received by the respective antenna elements 1*a*–1*d*.

In this manner, when the components of the unit direction vector D of the beam in the desired direction are transferred as data to each of the phase shifter control circuits 5*a*–5*d*, the phase data or the amount of phase shift of the electromagnetic waves to be transmitted or received by the respective antenna elements 1*a*–1*d* is computed and the computed phase data is transferred through the phase data holding circuit 5 to the associated phase shifter 4, so that the phase of the electromagnetic waves transmitted or received by each of the antenna elements 1*a*–1*d* is varied in accordance with Equation (1) by each of the phase shifters 4*a*–4*d* associated with each of the antenna elements. Thus, the beam of electromagnetic waves transmitted or received by the whole antenna elements 1*a*–1*d* is directed in the desired direction.

The data inputted into the respective phase shifter control circuits 5*a*–5*d* is accepted only when an X-enable signal and a Y-enable signal are simultaneously supplied to both the X-enable and Y-enable lines 29*a*, 29*b* and 30*a*, 30*b*, respectively, connected to the respective phase shifter control circuits 5*a*–5*d*. In the event of transfer of data which is common to all of the phase shifter control circuits, such as each of the components of the unit direction vector D in the desired direction, the transfer of such data may be achieved while the X-enable signal are supplied to all of the X-enable lines 29*a*, 29*b* and the Y-enable signal also to all of the Y-enable lines 30*a*, 30*b*. In contrast, in the case that individual data is transferred to the specified phase shifter control circuits 5*a*–5*d*, that is, in such an event that the coordinates of the respective antenna elements 1*a*–1*d* or the correction data corresponding thereto are held in their coordinate holding circuit 9 or correction data holding circuit 11 in the initial condition, for example when it is preferable for data to be transferred only to the phase shifter control circuit 5*a*, X-enable signal is supplied only to the X-enable line 29*a* and Y-enable signal also only to the Y-enable line 30*a*. Thus, the data may be transferred in such a condition that the X-enable and Y-enable signals have only been supplied to X-enable and Y-enable lines 29*a*, 29*b* and 30*a*, 30*b* connected to phase shifter control circuits to which the data is transferred.

As described above, in the prior art system for transferring antenna control data, when the data is transferred to each of the phase shifter control circuits 5*a*–5*d*, the X-enable and Y-enable lines 29*a*, 29*b* and 30*a*, 30*b* are used and thus the number of the X-enable and Y-enable lines must be increased as the number of the antenna elements increases.

Furthermore, since the data line 14 is also commonly connected to the phase shifter control circuits 5*a*–5*d*, if the number of the antenna elements 1*a*–1*d* exceeds the maximum connections to a data supply circuit (not shown) outside the antenna control data transfer system, it will then be necessary to increase the number of the data lines 14. This is also true of the X-enable and Y-enable lines 29*a*, 29*b* and 30*a*, 30*b*. Therefore, there were drawbacks that as the number of the antenna elements increase the number of the X-enable and Y-enable lines 29*a*, 29*b* and 30*a*, 30*b* and the data lines 14 is increased, and correspondingly the number of the external connections of the system is increased.

SUMMARY OF THE INVENTION

It is therefore an object of the present invention to provide an antenna control data transfer system which can overcome the above-described drawbacks and in which even if the number of the antenna elements increases the number of the external connections of the system associated with the X-enable and Y-enable lines can be reduced and the external connections of the system associated with the data lines can be held at a fixed amount.

The antenna control data transfer system in accordance with the present invention comprises a plurality of phase shifter control circuits for controlling phase shifters which are capable of changing the phase of electromagnetic waves to be transmitted or received by antenna elements, wherein each of the phase shifter control circuits includes an address holding circuit for holding an address for identifying each phase shifter control circuit, a data input circuit for inputting data from the outside of the system and a data output control circuit for either outputting the inputted data or inhibiting the inputted data from being outputted in accordance with a data output control signal from a signal processing circuit which processes the inputted data, the data output side of the data input circuit being directly connected to the data input side of the data output control circuit and the plurality of the phase shifter control circuits being sequentially connected one after the other through a data line.

Thus, the phase shifter control circuit is provided therein with the address holding circuit for holding the address for identifying the phase shifter control circuit, the data input circuit for inputting data, and the data output control circuit for outputting the inputted data or preventing the data from being sent out in accordance with the data output control signal from the signal processing circuit, the data output side of the data input circuit and the data input side of the data output control circuit being directly connected to each other, whereby the address holding circuit may hold another address which is commonly to all of the phase shifter control circuits in addition to the address for identifying the individual phase shifter control circuit, and the signal processing circuit in the phase shifter control circuit performs signal processing operation only when the address held in the address holding circuit and the address included in the inputted data coincide with each other. With such arrangement, the X-enable and Y-enable lines required in the conventional antenna control data transfer system can be eliminated. Furthermore, since the plurality of phase shifter control circuits is sequentially connected one after the other through a data line, the number of connections to be outside of the system is not increased even when the number of the antenna elements and thus of the phase shifter control circuits increases.

Thus, even if the number of the antenna elements increases, the external connections of the system can be kept constant by deleting the X-enable and Y-enable lines.

BRIEF DESCRIPTION OF THE DRAWINGS

These and other objects and features of the invention will be readily appreciated by reference to the embodiments shown in the accompanying drawings which are given as mere examples and in which.

DETAILED DESCRIPTION OF THE PREFERRED EMBODIMENTS

Figure 1:
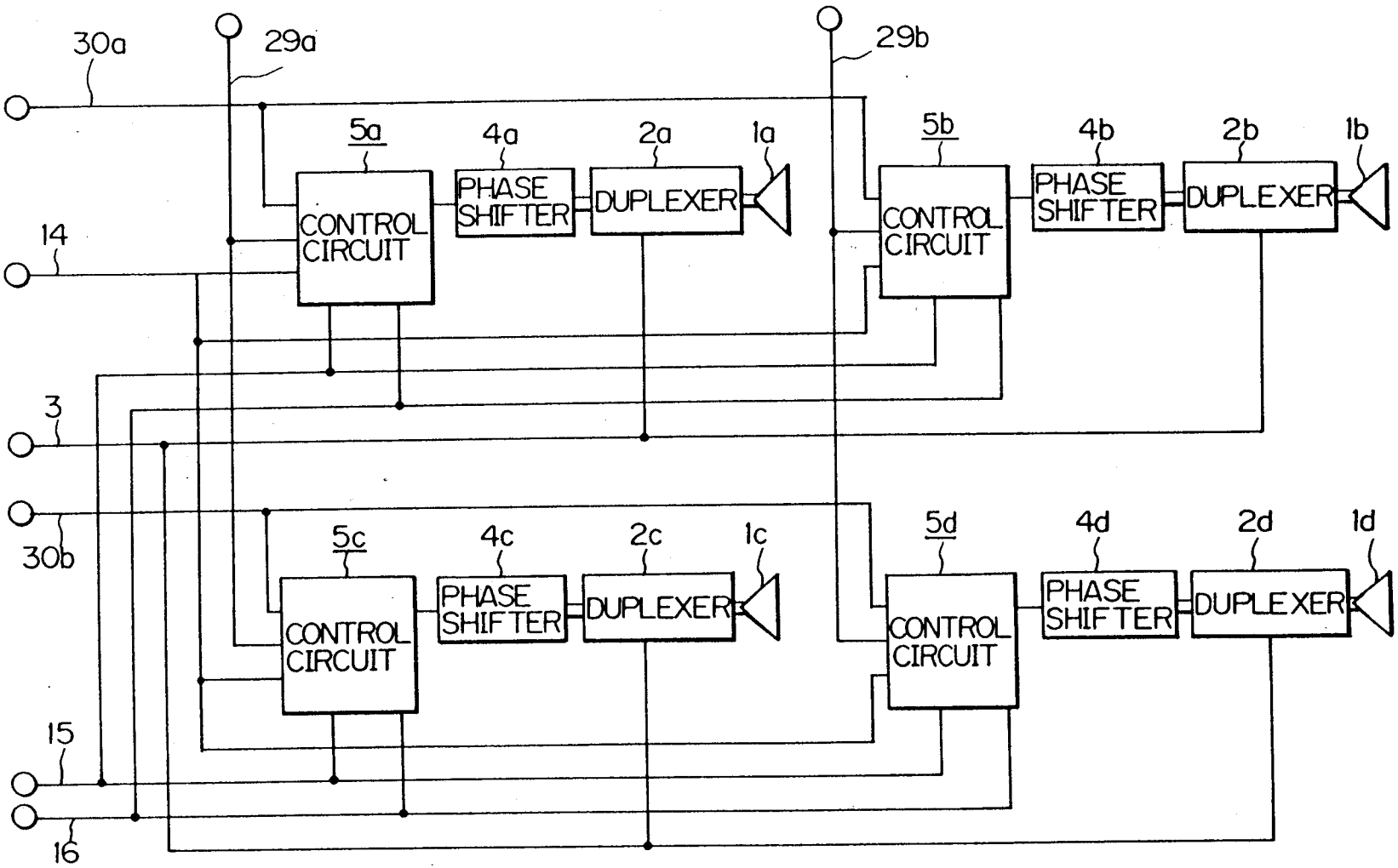
Fig.1 (PRIOR ART)
FIG. 1 is a schematic representation of the arrangement of a conventional system for transferring antenna control data.
Figure 2:
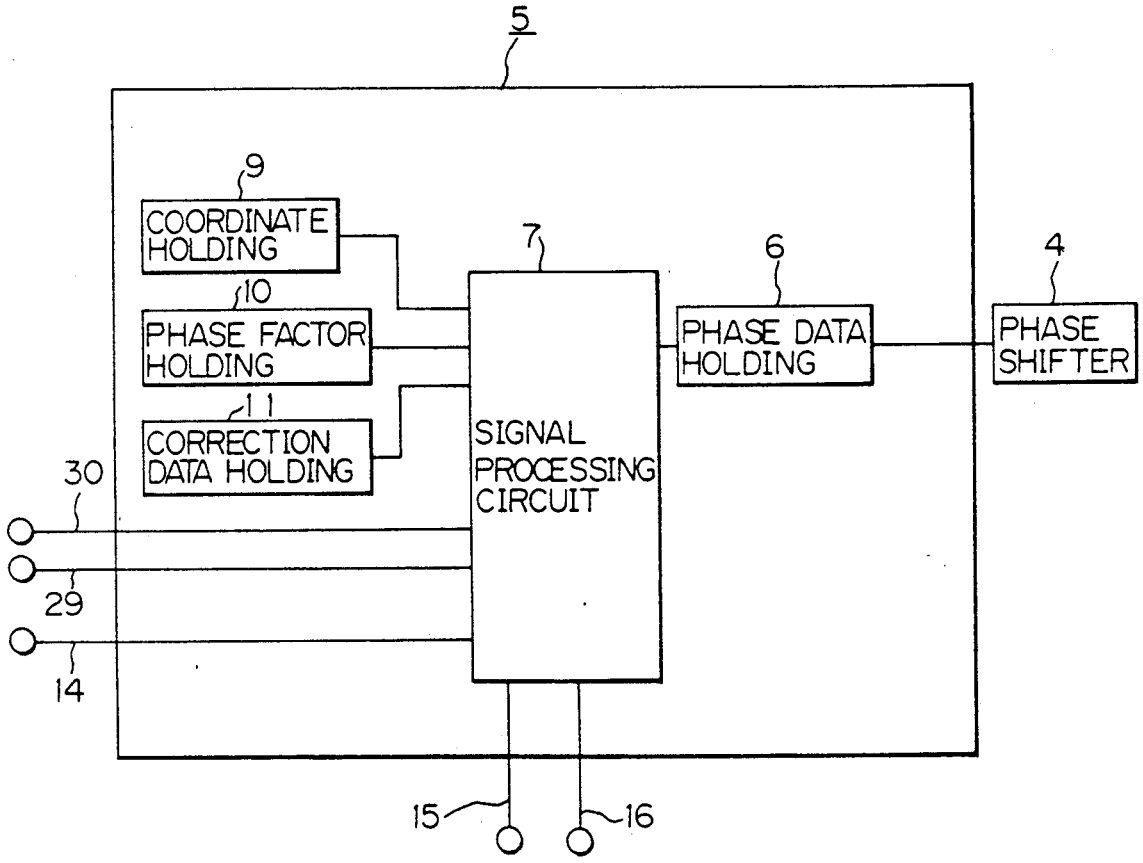
Fig.2 (PRIOR ART)
FIG. 2 is a schematic representation of the internal arrangement of each of the phase shifter control circuits of the conventional system for transferring antenna control data.
Figure 3:
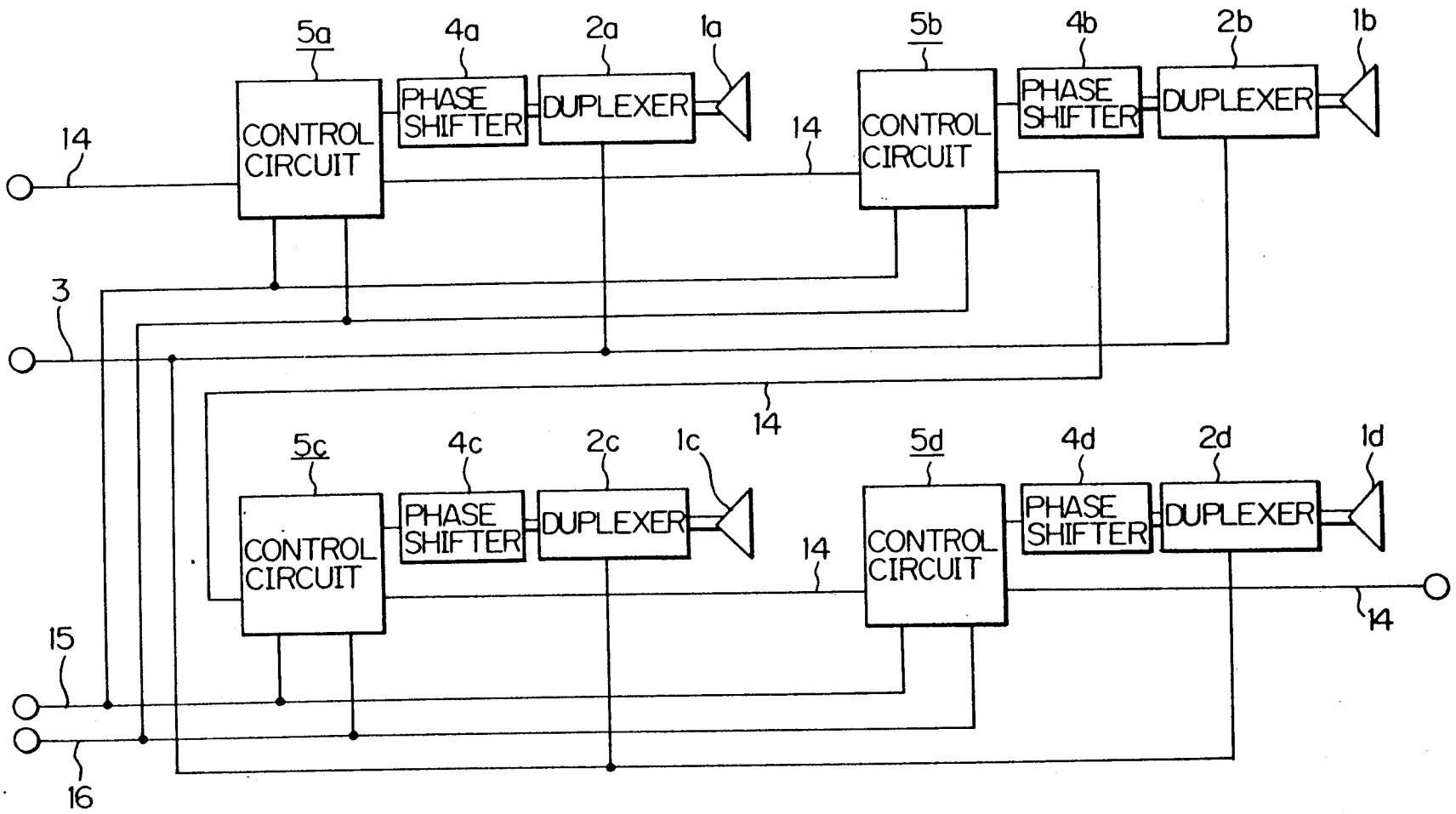
FIGS. 3, 6, 8, 13, 15, 17, 18 and 20 are schematic representations of the arrangement of various embodiments of the present invention.

FIG. 3 shows an embodiment of the present invention which comprises, as shown, antenna elements (apertures) 1*a*–1*d* for transmitting or receiving electromagnetic waves, duplexers 2*a*–2*d* for switching the antenna elements for alternate use for transmitting and receiving the electromagnetic waves from and to the antenna elements 1a–1d, a duplexer control signal line 3 for carrying a duplexing signal to the duplexers 2a–2d, phase shifters 4a–4d for shifting the phase of the electromagnetic waves to be transmitted or received by the antenna elements 1a–1d, phase shifter control circuits 5a–5d for controlling the amount of phase shift of the electromagnetic waves provided by the phase shifters 4a–4d, a data line 14 for transferring data for controlling the phase shifters 4a–4d to the respective phase shifter control circuits 5a–5d, a clock line 15 for delivering a clock signal which is used by each of the circuits 5a–5d as a trigger to latch the data from the data line 14 or perform various operation, and a reset line 16 for transferring a reset signal for resetting each of the circuits 5a–5d.

Figure 4:
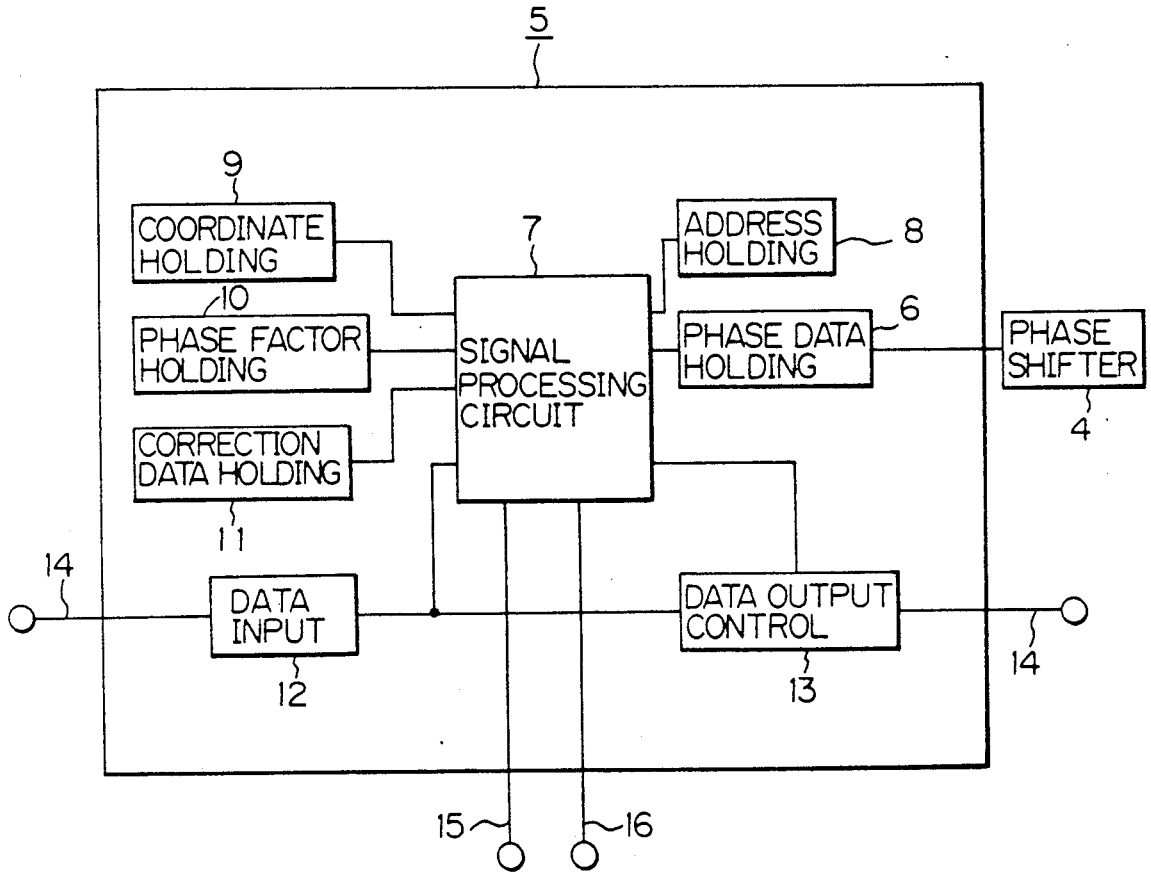
FIGS. 4, 5, 7, 9, 11, 14, 16, 19 and 21 are schematic representations of the internal arrangement of the phase shifter control circuits of the embodiments of the invention.

FIG. 4 is a schematic representation of the arrangement of the exemplary circuit 5 of the phase shifter control circuits 5a–5d of the embodiment of the invention. Each phase shifter control circuit 5 includes a phase data holding circuit 6 for holding the phase data or the amount of phase shift of the electromagnetic waves provided by the associated phase shifter 4, a signal processing circuit 7 for performing signal processing according to the data from the data line 14, an address holding circuit 8 for holding an address for identifying the phase shifter control circuits 5a–5d, a coordinate holding circuit 9 for holding the coordinates of the antenna element associated with the phase shifter control circuit 5, a phase factor holding circuit 10 for holding the phase factor to be used when the signal processing circuit 7 computes the amount of phase shift of the electromagnetic waves according to the data from the data line 14, a correction data holding circuit 11 for holding the correction data for compensating the computed value for the error due to variations of electrical length of the transmission of the electromagnetic waves to the antenna elements, a data input circuit 12 for inputting data through the data line 14 from the outside of the system, and a data output control circuit 13 for deciding whether the inputted data is delivered or not from the circuit 5 according to the data output control signal from the signal processing circuit 7.

The operation of the system as arranged above will now be described. In the case of initial condition, first the addresses for identifying the respective phase shifter control circuits 5a–5d are transferred to the respective phase shifter control circuits 5a–5d. In the initial condition, if the same data is transferred to all of the phase shifter control circuits, the signal processing circuits 7 of all of the phase shifter control circuits would do the same processing so that the same address will be held in the address holding circuits 8 of all of the phase shifter control circuits. In order to allow each of the address holding circuits 8 of the respective phase shifter control circuits 5a–5d to hold an individual address, a reset signal is first supplied through the reset line 16 to the respective phase shifter control circuits 5a–5d to reset the latter so that the respective data output control circuits 13 are held in such a condition that they are inhibited from outputting any data in response to the data output control signals from the signal processing circuits 7. In this condition, if data for holding the first address is supplied to the data line 14 from the outside of the antenna control data transfer system, the data for holding the first address is first applied to the phase shifter control circuit 5a through its data input circuit 12 and then processed by the signal processing circuit 7 so that the first address is held in the address holding circuit 8 of the phase shifter control circuit 5a. Since the data output control circuit 13 of the phase shifter control circuit 5a is inhibited from outputting the data for holding the first address, the data for holding the first address is not delivered to the remaining phase shifter control circuits 5b–5d.

Next, the phase shifter control circuit 5a which is holding the first address is provided with address rehold-inhibiting data and data for resetting the data output control signal. Thus, if data for holding the second address is then transferred, such data is inputted in the phase shifter control circuit 5a through its data input circuit 12. However, since the phase shifter control circuit 5a has already received the address rehold-inhibiting data, the circuit 5 will not hold the second address but continue to hold the first address. Moreover, since the phase shifter control circuit 5a has also been supplied with the data for resetting the data output control signal, the data output control signal from the signal processing circuit 7 is removed and the data output control circuit 13 can output the data. Thus, the data for holding the second address is transferred through the data input circuit 12 of the phase shifter control circuit 5a, to the data output control circuit 13, and the data line 14 to the subsequent phase shifter control circuit 5b by way of its data input circuit 12. Then, the second address is held in the address holding circuit 8 of the phase shifter control circuit 5b. Since data for resetting the data output control signal has not yet been transferred to the phase shifter control circuit 5b, data for holding the second address is not outputted from the data output control circuit 13 of the phase shifter control circuit 5b. Next, the address rehold-inhibiting data and data for resetting the data output control signal are then transferred to the phase shifter control circuit 5b which is holding the second address, thereby preventing new addresses from being held and maintaining the data output control circuit 13 in its data outputting condition.

After all of the phase shifter control circuits 5a–5d have been reset in such a manner as described above, data for holding the i-th (i=1, 2, 3, . . . ) address is transferred so that the transfer of the address rehold-inhibiting data and the data for resetting the data output control signal to the phase shifter control circuit holding the i-th address can successively be repeated. As a result, the individual addresses are held in the address holding circuits 8 of the corresponding phase shifter control circuits 5a–5d. Further, in the case where the individual data is transferred to the desired one of the phase shifter control circuits 5a–5d, for example, when the coordinates of the respective antenna elements 1a–1d or the correction data corresponding thereto are held in the coordinate holding circuit 9 or the correction data holding circuit 11 in the associated one of the phase shifter control circuits 5a–5d, the individual data is transferred together with the address of the desired one of the phase shifter control circuits 5a–5d. The phase shifter control circuits 5a–5d perform processing only when the address held in the address holding circuit 8 therein and the address attached to the transferred data coincide with each other.

In the case where it is desirable for all of the phase shifter control circuits 5a–5d to be supplied with a common data, a common address is previously held in the address holding circuit 8 of the respective phase shifter control circuits 5a–5d, and then the common data with the common address is transferred.

In regard to the operation of setting the beam of electromagnetic waves transmitted or received by the whole of the antenna elements 1a–1d in a desired direction, if the data of the components of the unit direction vector D in the desired direction is transferred with a common address, the subsequent operation of the phase shifter control circuits 5a–5d is the same as that of the prior art system.

Thus, in order for the beam of electromagnetic waves transmitted from the whole of the antenna elements 1a–1d to be set in the desired direction, it is not necessary to provide the X-enable and Y-enable lines 29a, 29b and 30a, 30b of the prior art system for transferring the data to the respective phase shifter control circuits 5a–5d. Further, the problem raised by increase in the number of the antenna elements 1a–1d can be overcome by the connections between the phase shifter control circuits 5a–5d, so that even if the number of the antenna elements increases, the external connections of the antenna control data transfer system, that is, the X-enable and Y-enable lines 29a, 29b and 30a, 30b can be eliminated. Accordingly, the external connections of the antenna control data transfer system associated with the data line 14 can be reduced to a fixed amount.

Figure 5:
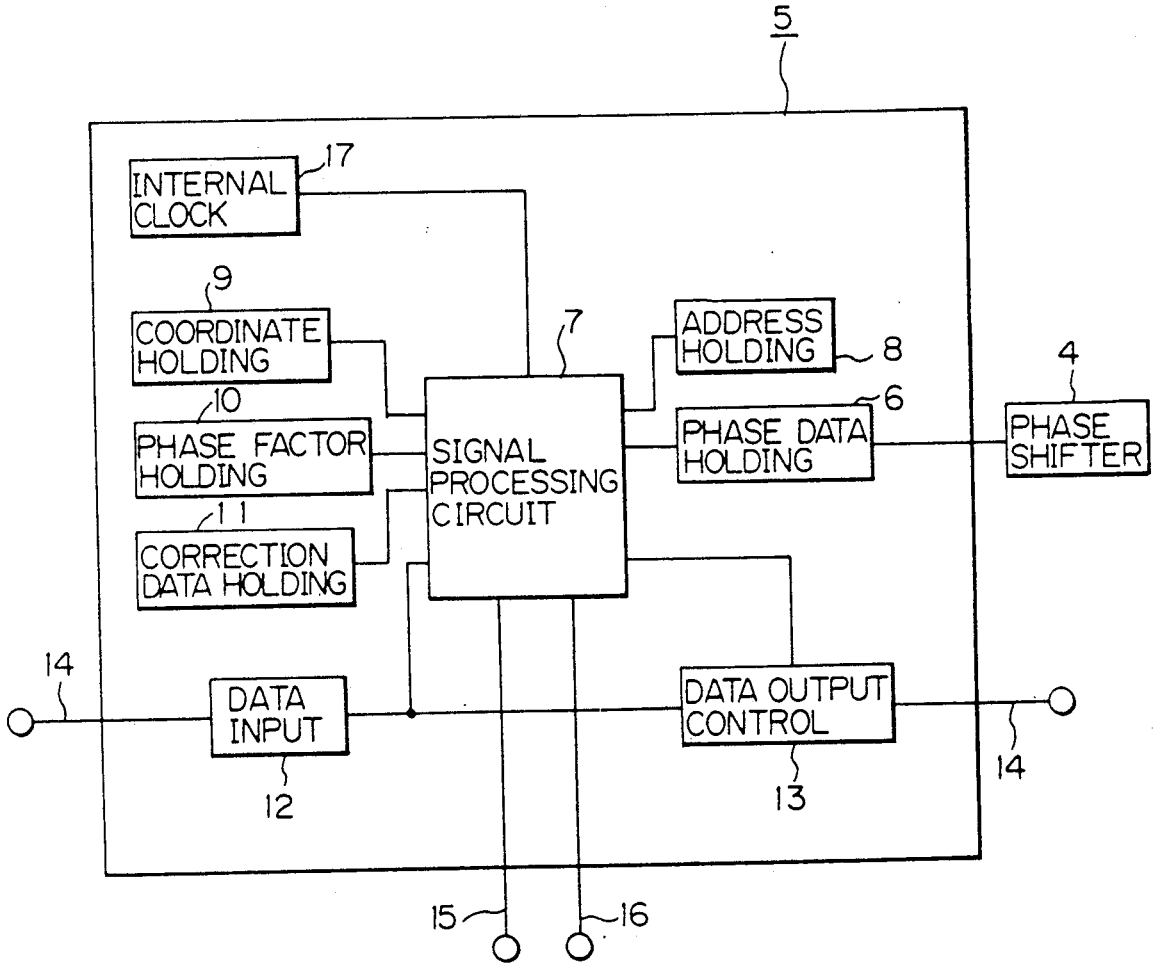

FIG. 5 shows another embodiment in which the phase shifter control circuits 5a–5d are provided with an internal clock generating circuit 17 therein. The frequency of the clock supplied from a clock line 15 is limited approximately to several MHz due to the restriction on the length of the clock line 15. In the embodiment, since the internal clock signals are generated by the internal clock generating circuit 17 and are used only within the phase shifter control circuits 5a–5d, the clock frequency can be increased to approximately several tens of MHz. Thus, since the internal clock signals are used for processing in the signal processing circuit 7 after data is inputted, the processing speed of the signal processing circuit 7 can effectively be enhanced.

Figure 6:
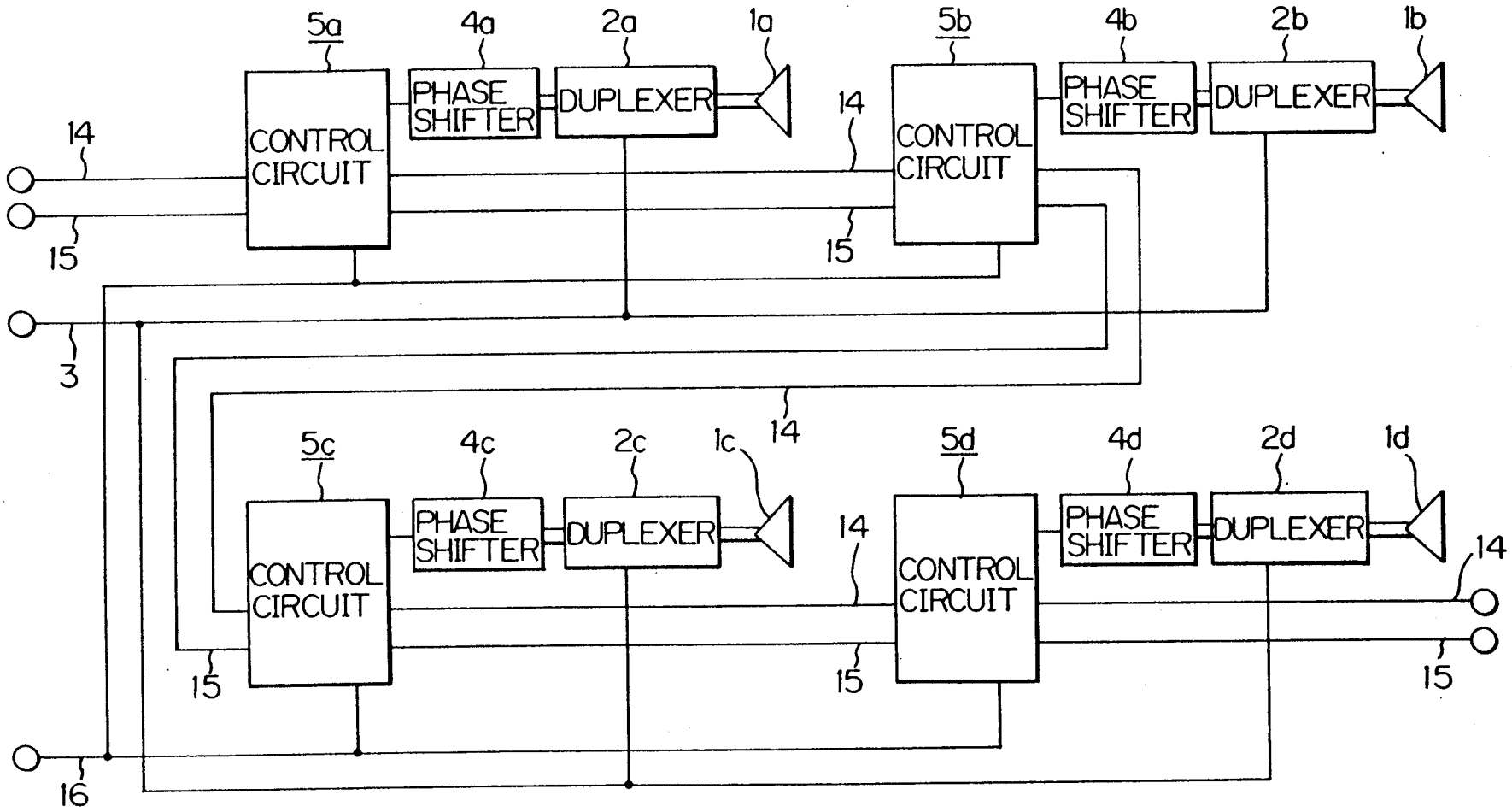
Figure 7:
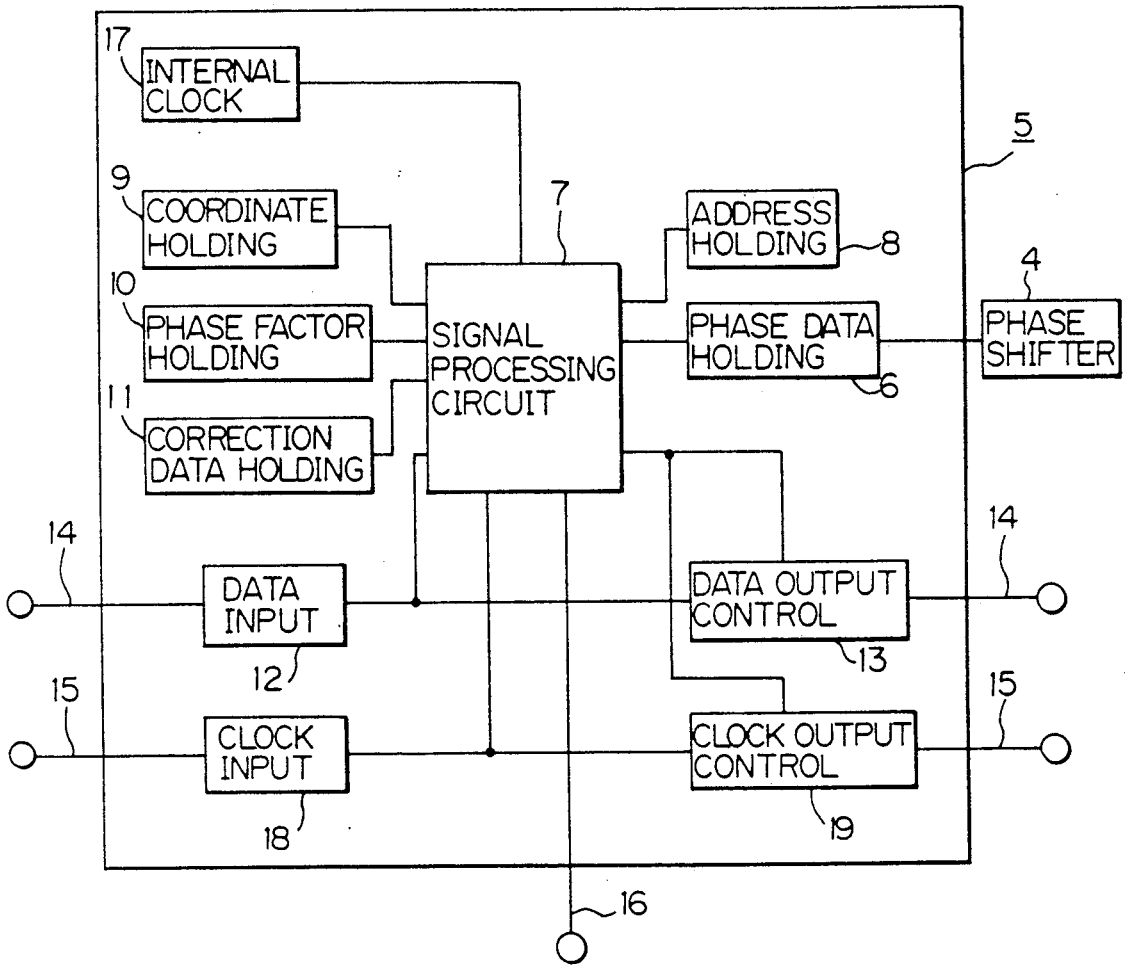

FIGS. 6 and 7 show another embodiment in which, as shown in FIG. 6, the clock line 15 as well as the data line 14 is connected through the phase shifter control circuits 5a–5d and, as shown in FIG. 7, the phase shifter control circuits 5a–5d are each provided therein with a clock input circuit 18 corresponding to the data input circuit 12 and a clock output control circuit 19 corresponding to the data output control circuit 13. In this embodiment, the problem of a time lag caused when data passes through the data input circuit 12 and the data output control circuit 13 of the respective phase shifter control circuits 5a–5d is overcome by introducing a similar time lag in the passage of clock signals through the clock input circuit 18 and the clock output control circuit 19 of the respective phase shifter control circuits 5a–5d, otherwise the simultaneous occurrence of the data and clock cannot be obtained. Also, according to this embodiment, even though the antenna elements increase in number, the amount of the connections outside the antenna control data transfer system is not increased.

Figure 8:
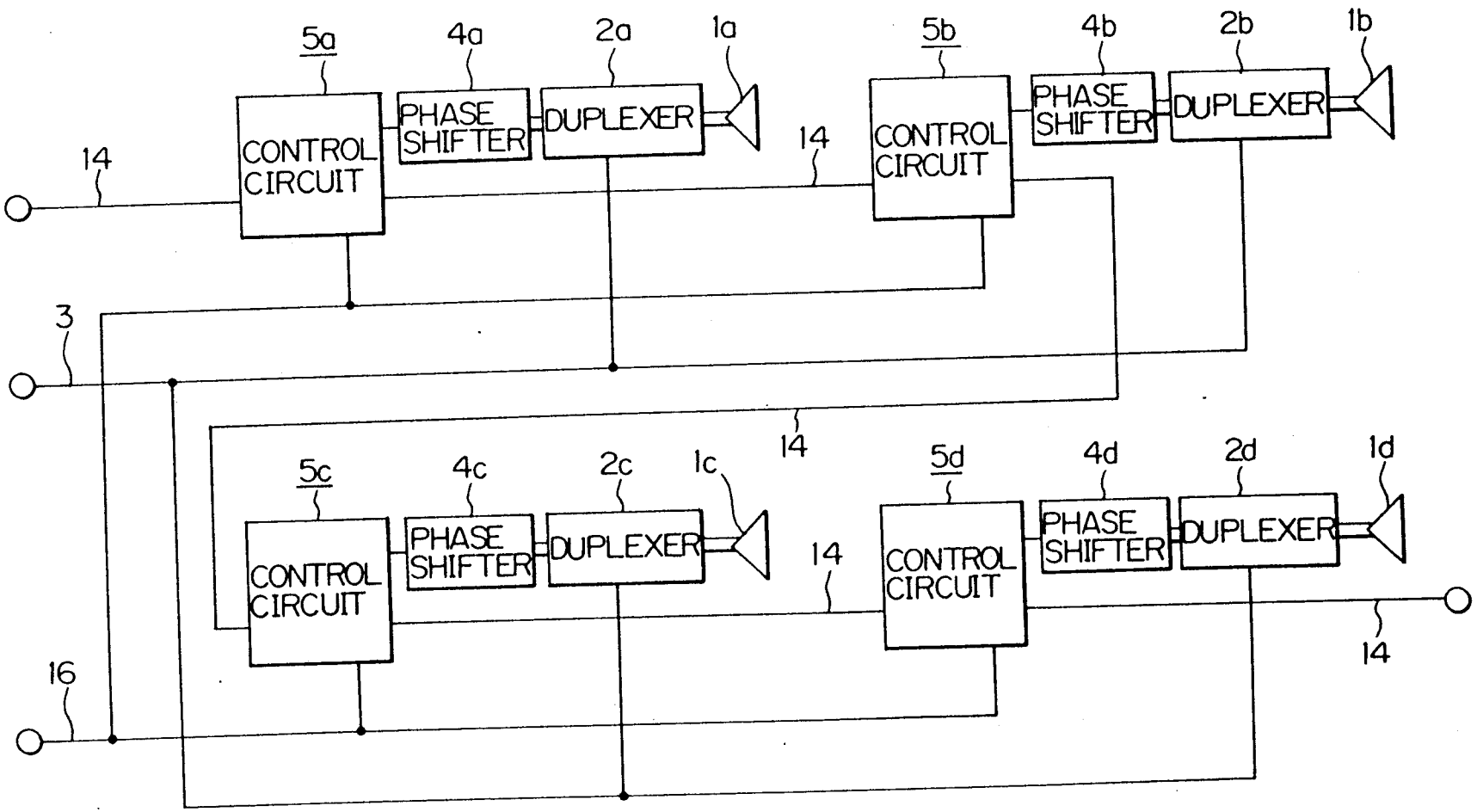
Figure 9:
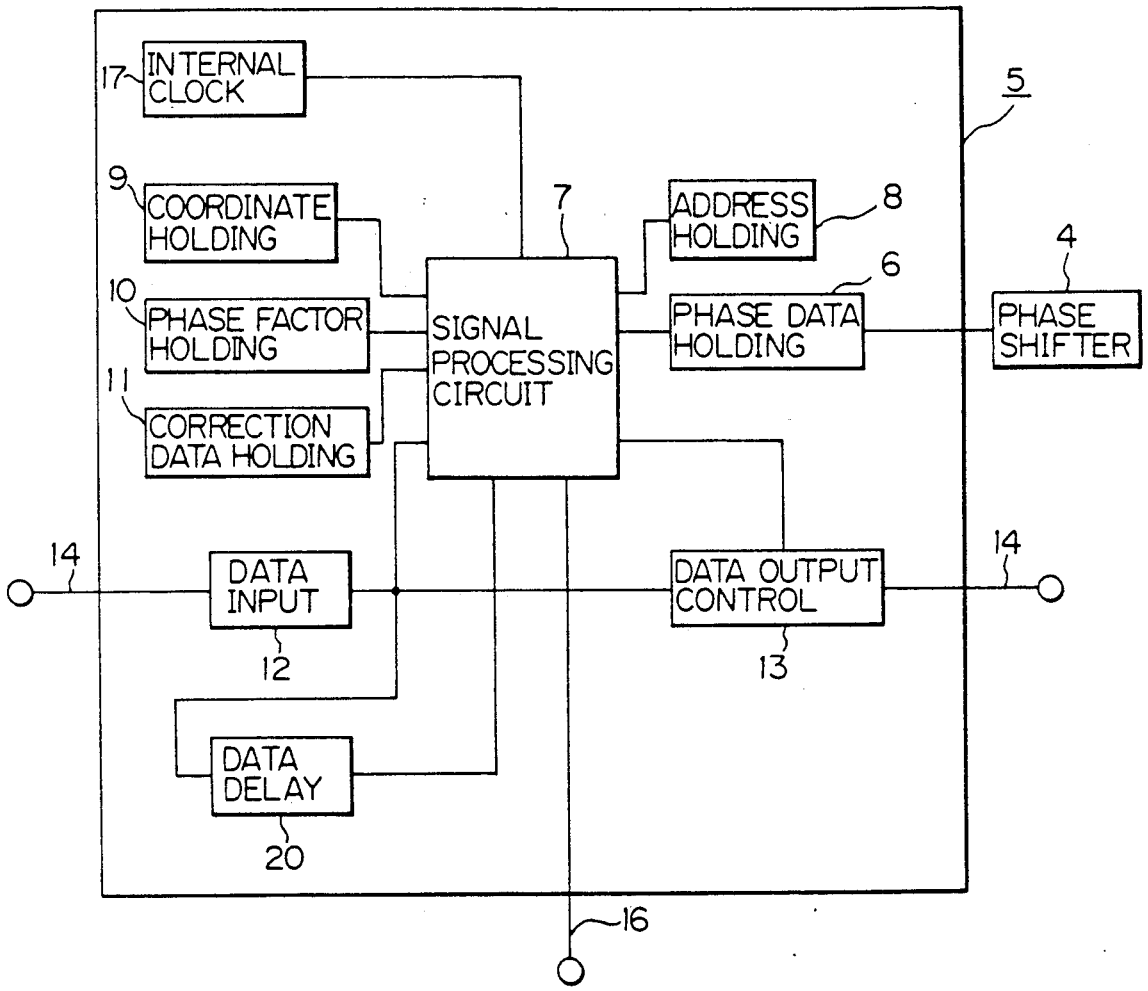
Figure 10:
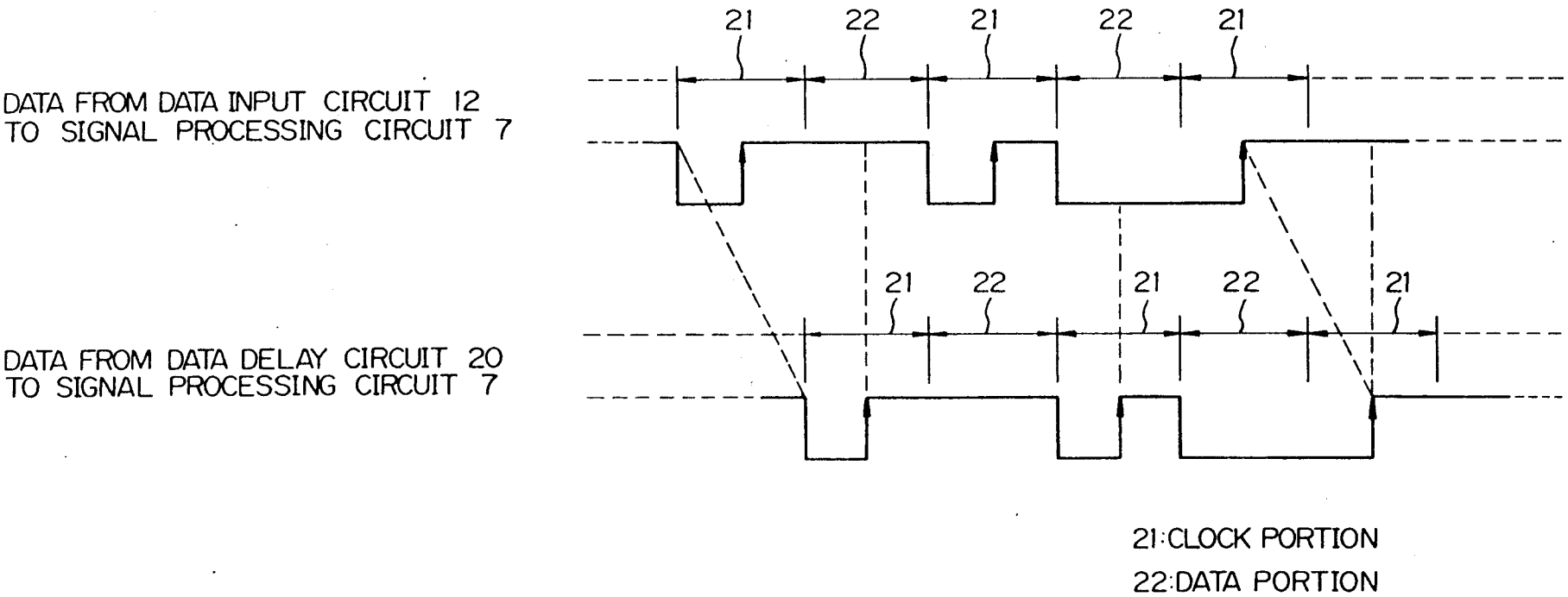
FIG. 10 is a schematic illustration of data of the embodiments of the invention.

FIGS. 8, 9 and 10 show a further embodiment in which, as shown in FIG. 9, a data delay circuit 20 is provided in the respective phase shifter control circuits 5a–5d and, as shown in FIG. 10, the data includes data portions 22 and clock portions 21. In this embodiment, the data from the data delay circuit 20 to the signal processing circuit 7, as shown at the lower portion in FIG. 10, is delayed by the data delay circuit 20 relative to the data from the data input circuit 12 to the signal processing circuit 7, as shown at the upper portion in FIG. 10, so that the data portions 22 shown at the upper portion therein become simultaneous with the clock portions 21 shown at the lower portion. Thus, if such clock portions are used as clock signals, the clock line 15 can be eliminated as shown in FIG. 8.

Figure 11:
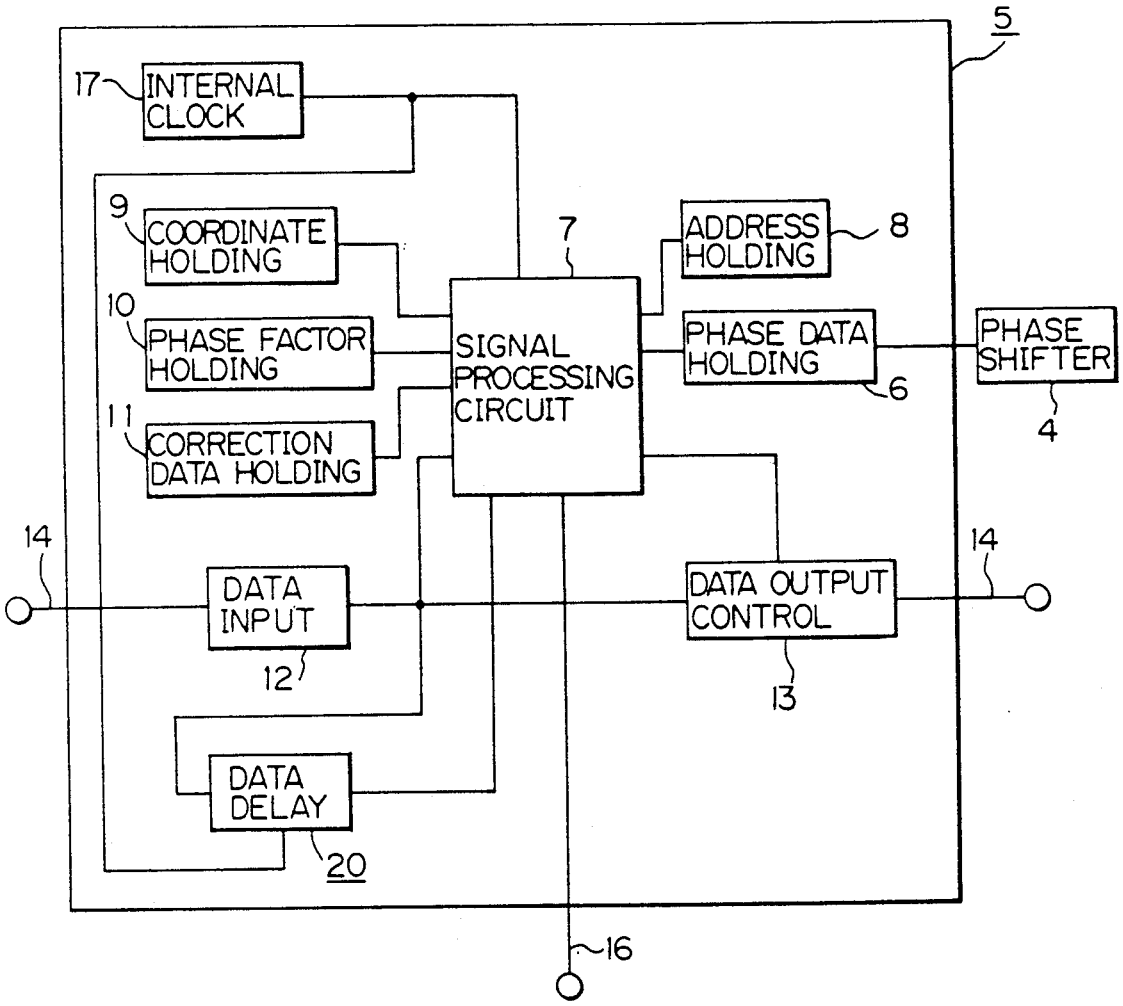
Figure 12:
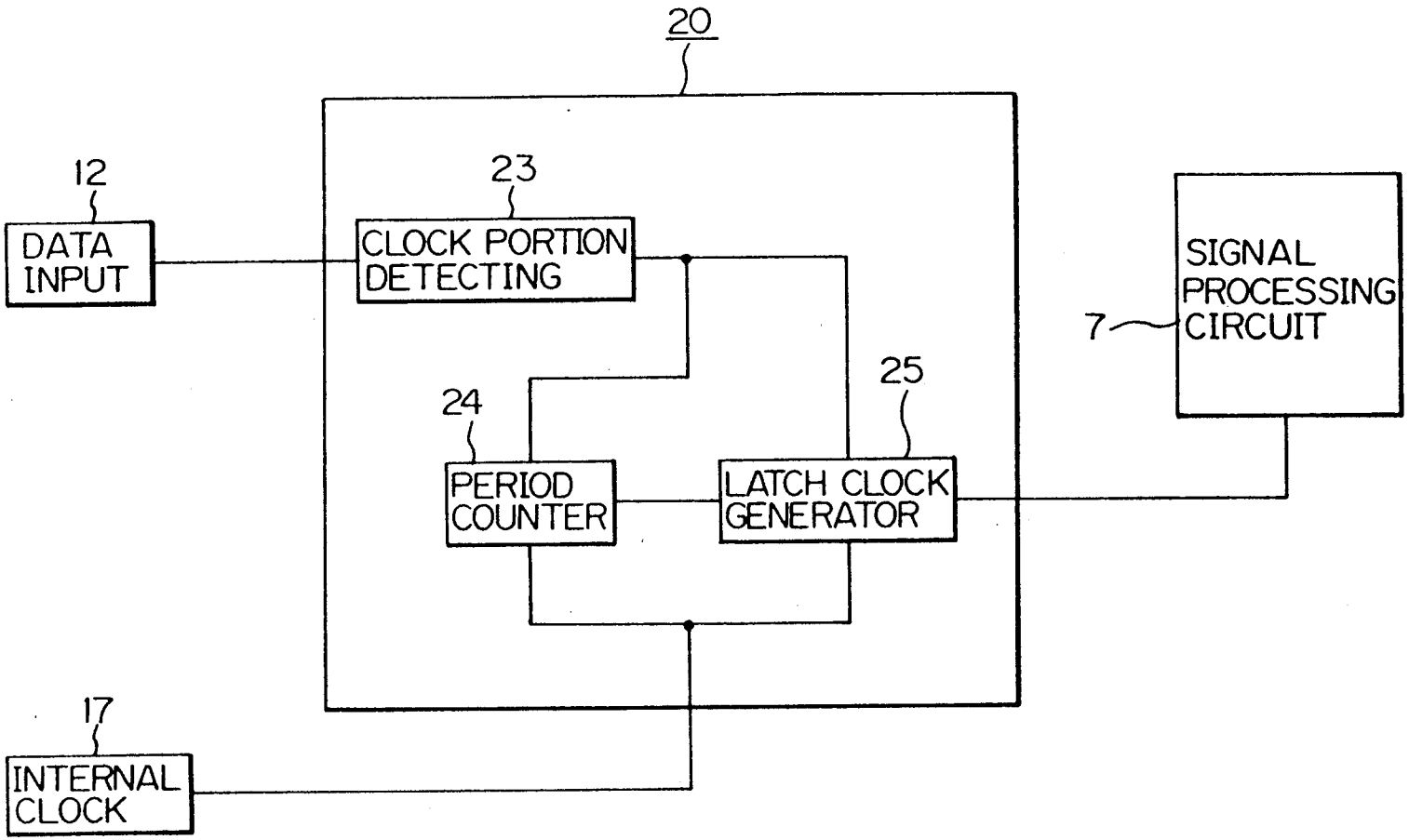
FIG. 12 is a schematic representation of the data delay circuit provided in the phase shifter control circuits of the embodiment of the invention.

FIGS. 11 and 12 show a still further embodiment in which, as shown in FIG. 11, the internal clock generating circuit 17 is connected to the data delay circuit 20 within the respective phase shifter control circuits 5a–5d. At the same time, as shown in FIG. 12, the data delay circuit 20 includes a clock portion detecting circuit 23, a period counter circuit 24 and a latch clock generating circuit 25. In this embodiment, the clock portion detecting circuit 23 detects the respective clock portions of the data to generate clock portion detection signals. The period counter circuit 24 detects the period between the clock portion detection signals from the clock portion detecting circuit 23 by counting the internal clock signals from the internal clock generating circuit 17. The latch clock generating circuit 25 generates latch clock signals corresponding to the clock portions of the data, on the basis of the count number from the period counter circuit 24 and the clock portion detection signals from the clock portion detecting circuit 23. More particularly, the circuit 25 generates the latch signals when the time corresponding to about one half of the period count number has lapsed after it has received each of the clock portion detection signals. As a result, since the delay time of latch clock signals is about one half of the period of the clock portions of the data, even if the period of the clock portions of the data arbitrarily changes, the delay time becomes about a half thereof, whereby the delay time always follows the arbitrary period of the clock portions of the data.

Figure 13:
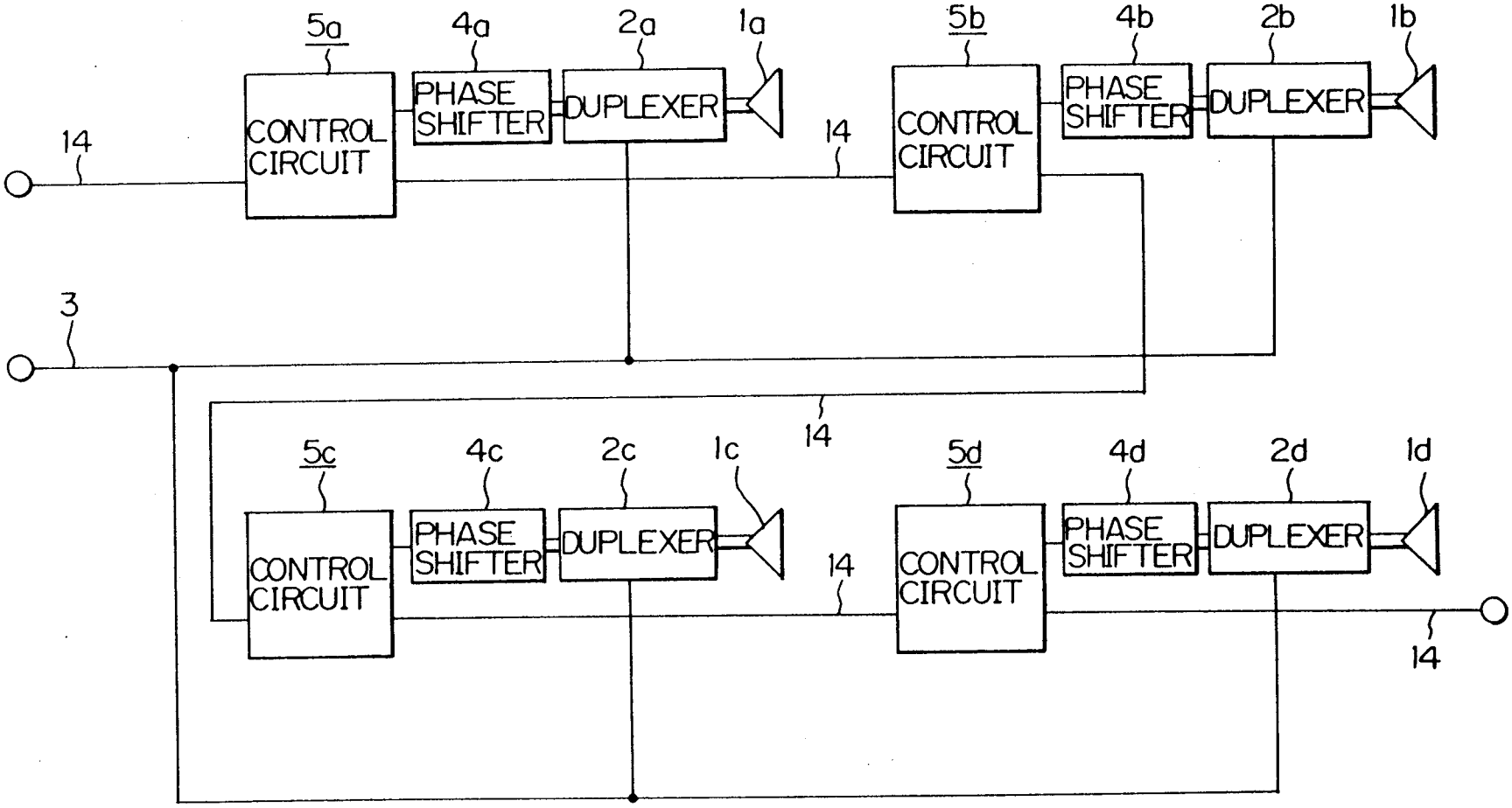
Figure 14:
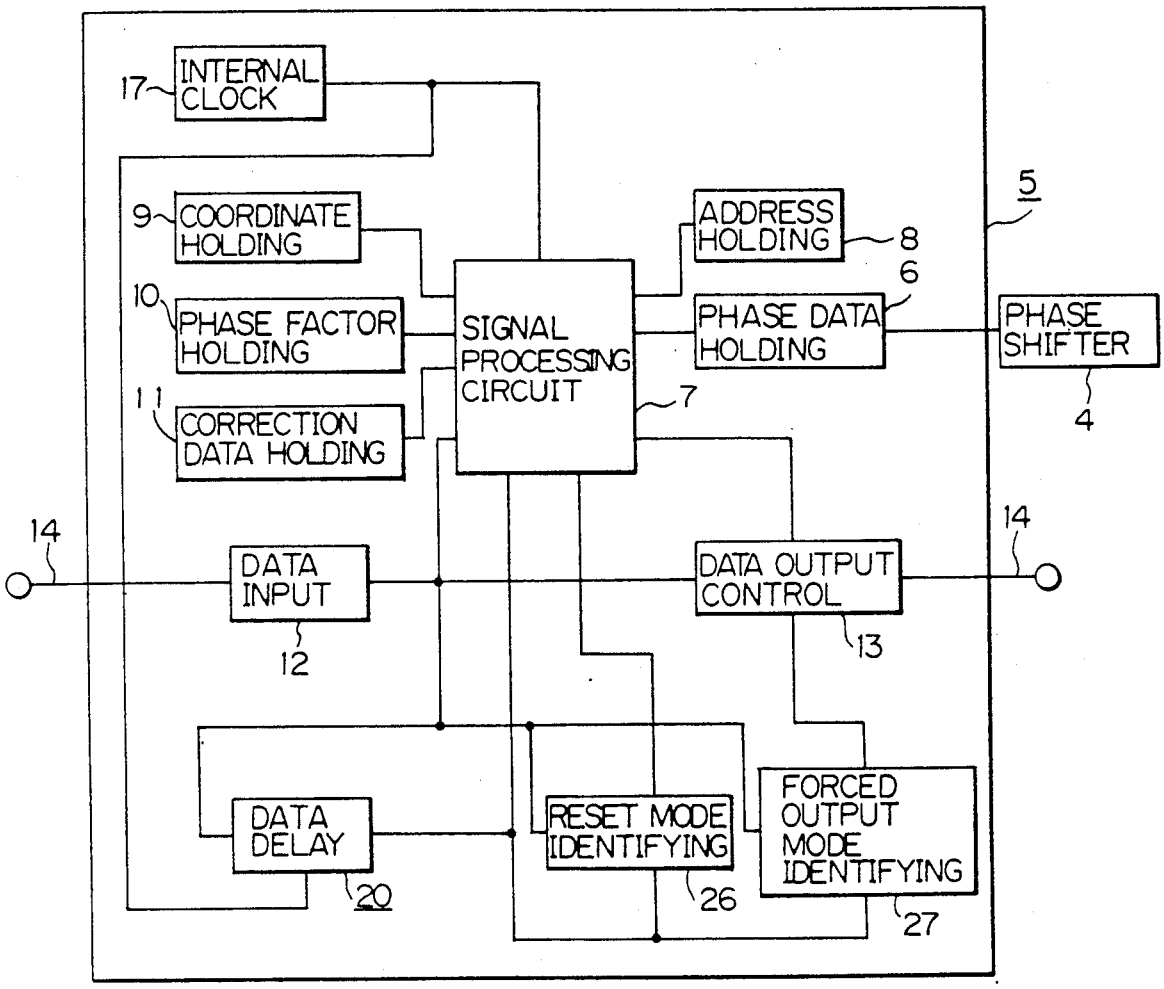

FIGS. 13 and 14 show a further embodiment in which, as shown in FIG. 14, the respective phase shifter control circuits 5a–5d further includes a reset mode identifying circuit 26 and a forced output mode identifying circuit 27. In this embodiment, when a reset mode data is inputted into the respective phase shifter control circuit 5a–5d, all the phase shifter control circuits 5a–5d are reset by the reset mode identifying circuit 26. When a forced output mode data is inputted into the respective phase shifter control circuits 5a–5d, the forced output mode identifying circuit enables the data output control circuit 13 to output data irrespective of the data output control signal from the signal processing circuit 7. If the forced output mode data is repeatedly transferred until it is received by all of the phase shifter control circuits 5a–5d, the data output control circuit 13 of all of the phase shifter control circuits 5a–5d will be in a condition to output the data. Then, if the reset mode data is transferred, all the phase shifter control circuits 5a–5d can be reset. Thus, the reset line 16 can be eliminated, as shown in FIG. 13.

Figure 15:
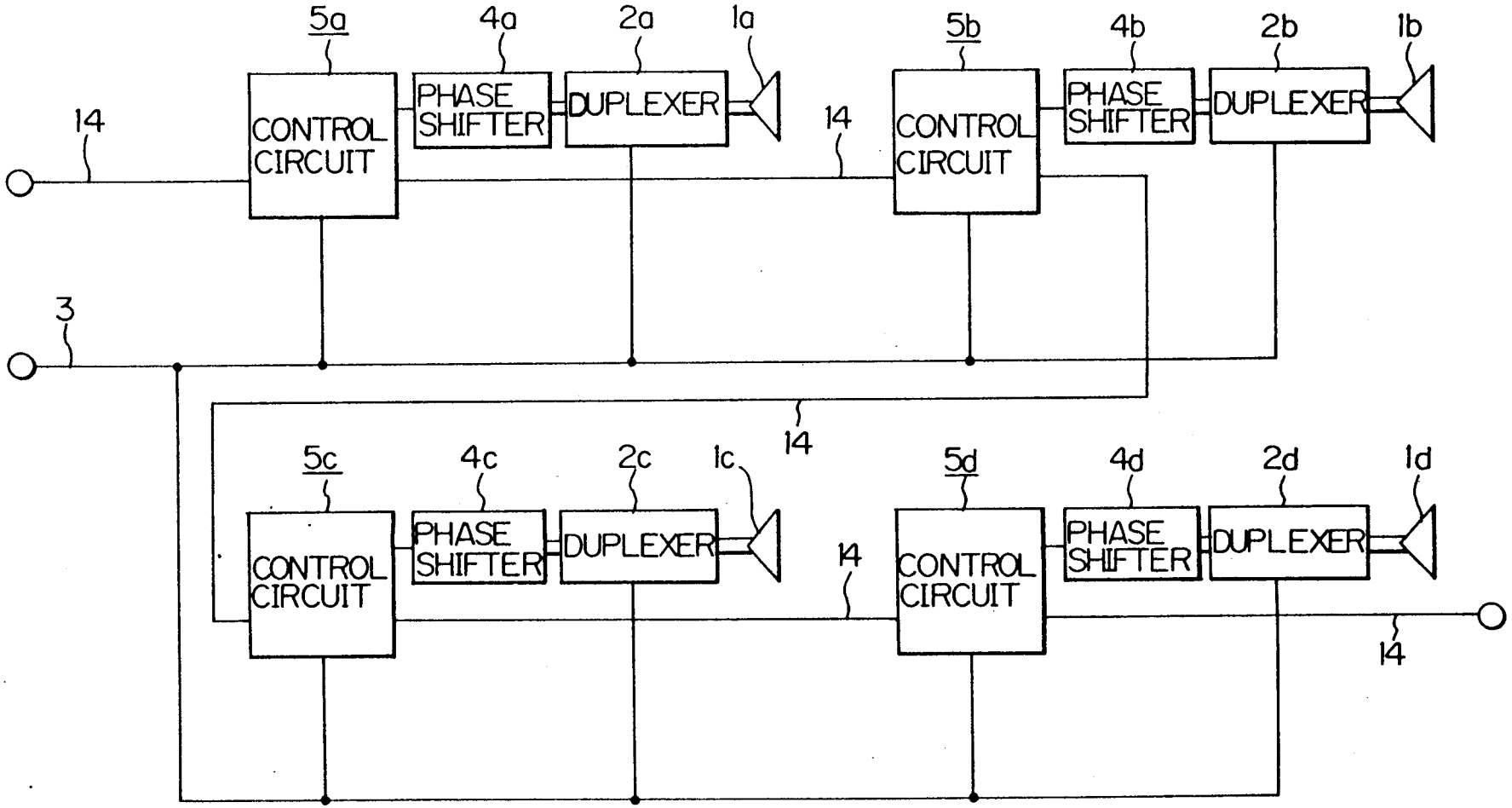
Figure 16:
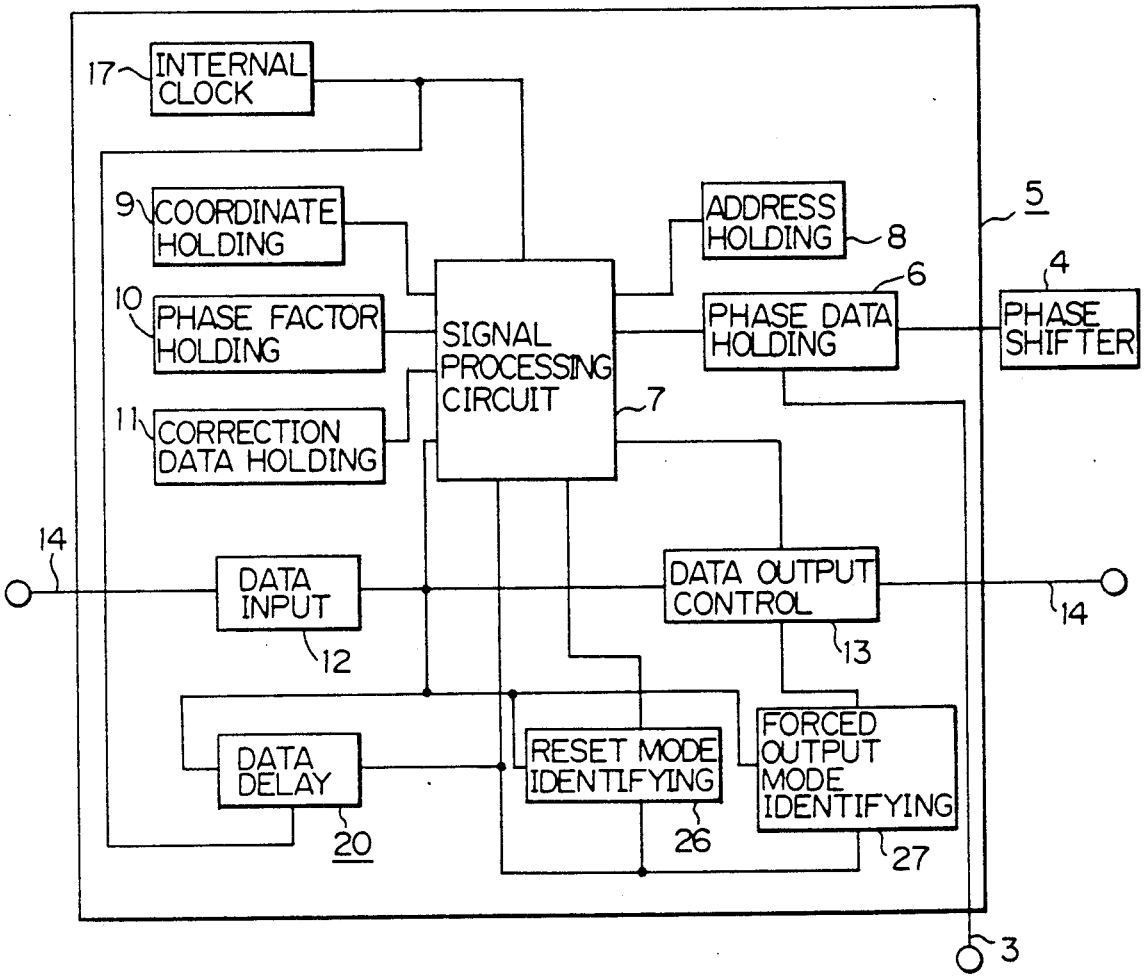

FIGS. 15 and 16 show a still further embodiment in which, as shown in FIG. 15, the duplexer control signal line 3 is also connected to the respective phase shifter control circuits 5a–5d and, as shown in FIG. 16, the duplexer control signal line 3 is also connected to the phase data holding circuit 6 within the respective phase shifter control circuits 5a–5d. In this embodiment, since the phase data holding circuits 6 of all of the phase shifter control circuits 5a–5d are commonly connected to the duplexer control signal line 3, when the phase data processed by the signal processing circuit 7 is held in the phase data holding circuits 6 using the duplexing signal, the phase data can simultaneously be held in the phase data holding circuits 6 of all of the phase shifter control circuits 5*a*–5*d*. Thus, the timing of holding the phase data can be kept accurate even if data passes sequentially through the respective phase shifter control circuits 5*a*–5*d*.

Figure 17:
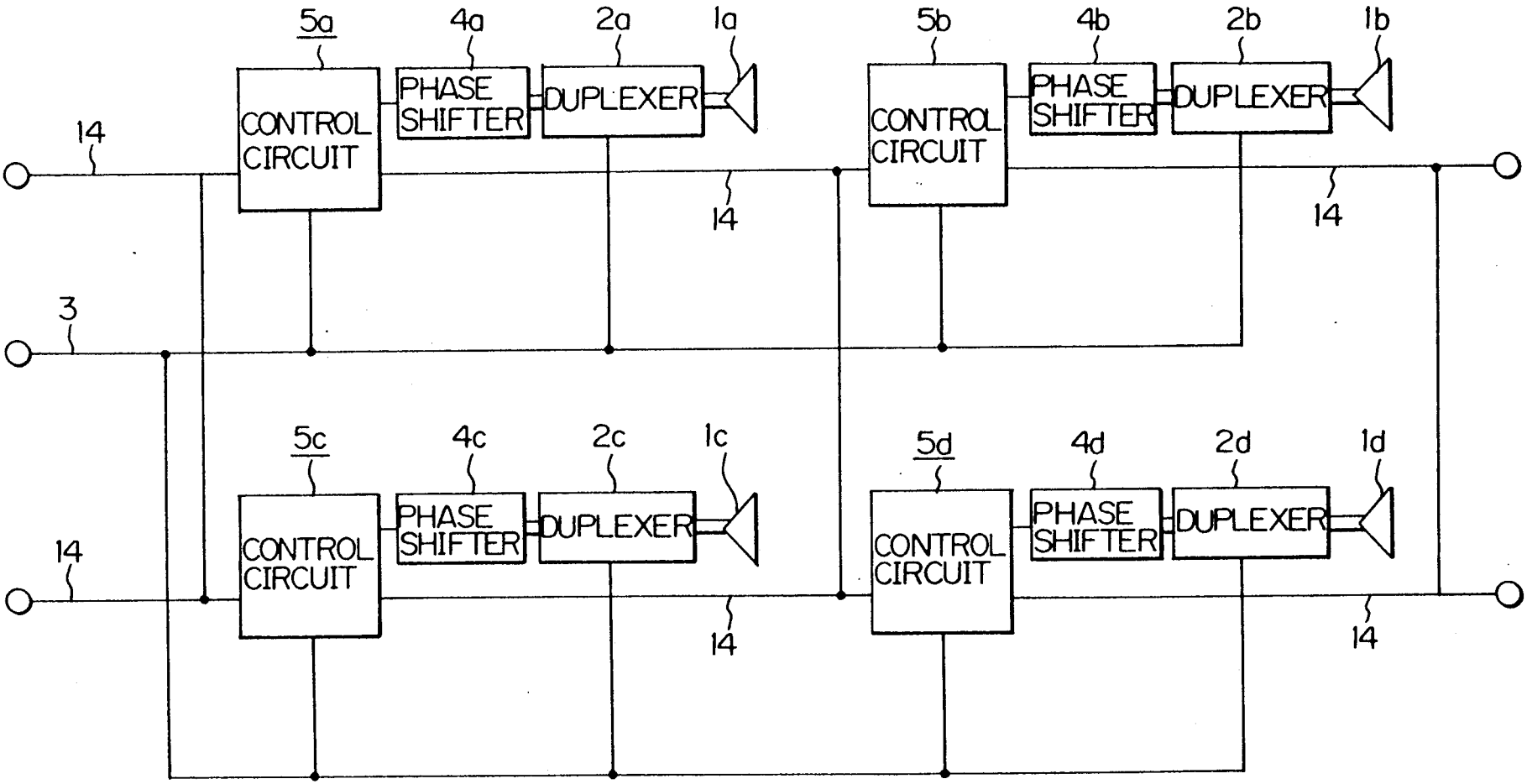

FIG. 17 shows a further embodiment in which a plurality of phase shifter control circuits 5*a*–5*d* is arranged in plural systematic lines and the corresponding data lines 14 between the systematic lines are connected to one another. In this embodiment, the data line 14 of the phase shifter control circuits 5*a* and 5*b* in a first system is connected to the data line 14 of the phase shifter control circuits 5*c* and 5*d* in a second system. For example, the data line 14 on the input side of the phase shifter control circuit 5*a* is connected to the data line 14 on the input side of the phase shifter control circuit 5*c* and the data line 14 on the input side of the phase shifter control circuit 5*b* is connected to the data line 14 on the input side of the phase shifter control circuit 5*d*. With this arrangement, even if any one of the phase shifter control circuits 5*a*–5*d* is out of order, the data can be transferred from the other phase shifter control circuit to the subsequent phase shifter control circuit and thus the effect of the breakdown of any one of the phase shifter control circuits is minimized and the whole system of the antenna control data transfer system can still operate.

Figure 18:
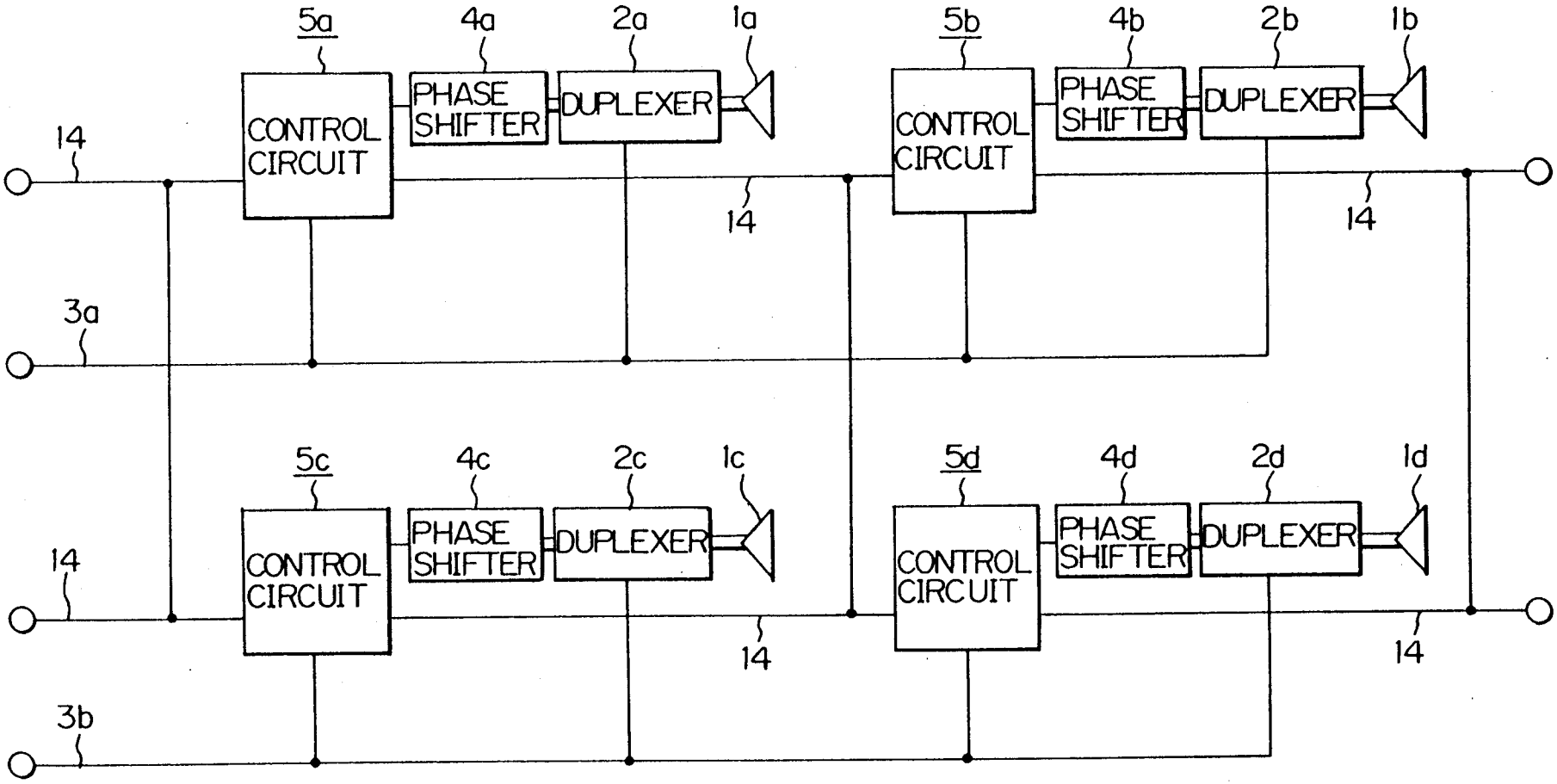
Figure 19:
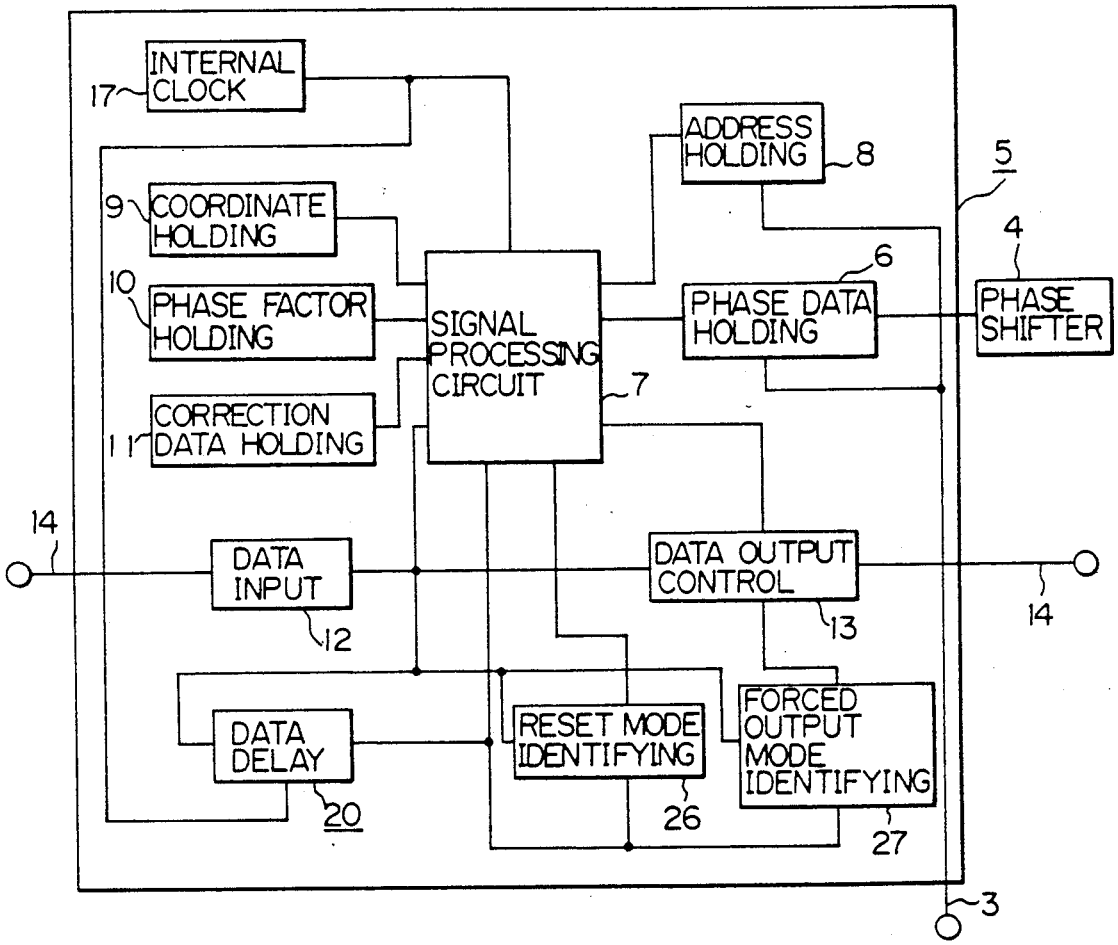

FIGS. 18 and 19 show another embodiment in which, as shown in FIG. 18, a plurality of phase shifter control circuits 5*a*–5*d* is arranged in plural systematic lines and the duplexer control lines 3*a* and 3*b* are independently connected to the respective systematic lines and, as shown in FIG. 19, the duplexer control lines 3*a* and 3*b*, are also connected to the address holding circuit 8 within the associated respective phase shifter control circuits 5*a*–5*d*. In this embodiment, when it is desirable to hold individual addresses in the respective phase shifter control circuits 5*a*–5*d*, first the phase shifter control circuits (here 5*a* and 5*b*) in a first group are enabled to accept the address signal and the phase shifter control circuits (here 5*c*, 5*d*) in a second group are not enabled by using the duplexing signals on the duplexer control lines 3*a* and 3*b*, and then the circuits in the second group are enabled and the circuits in the first group are not enabled, so that the address held in a phase shifter control circuit of the first group is different from that in the corresponding phase shifter control circuit of the second group.

Figure 20:
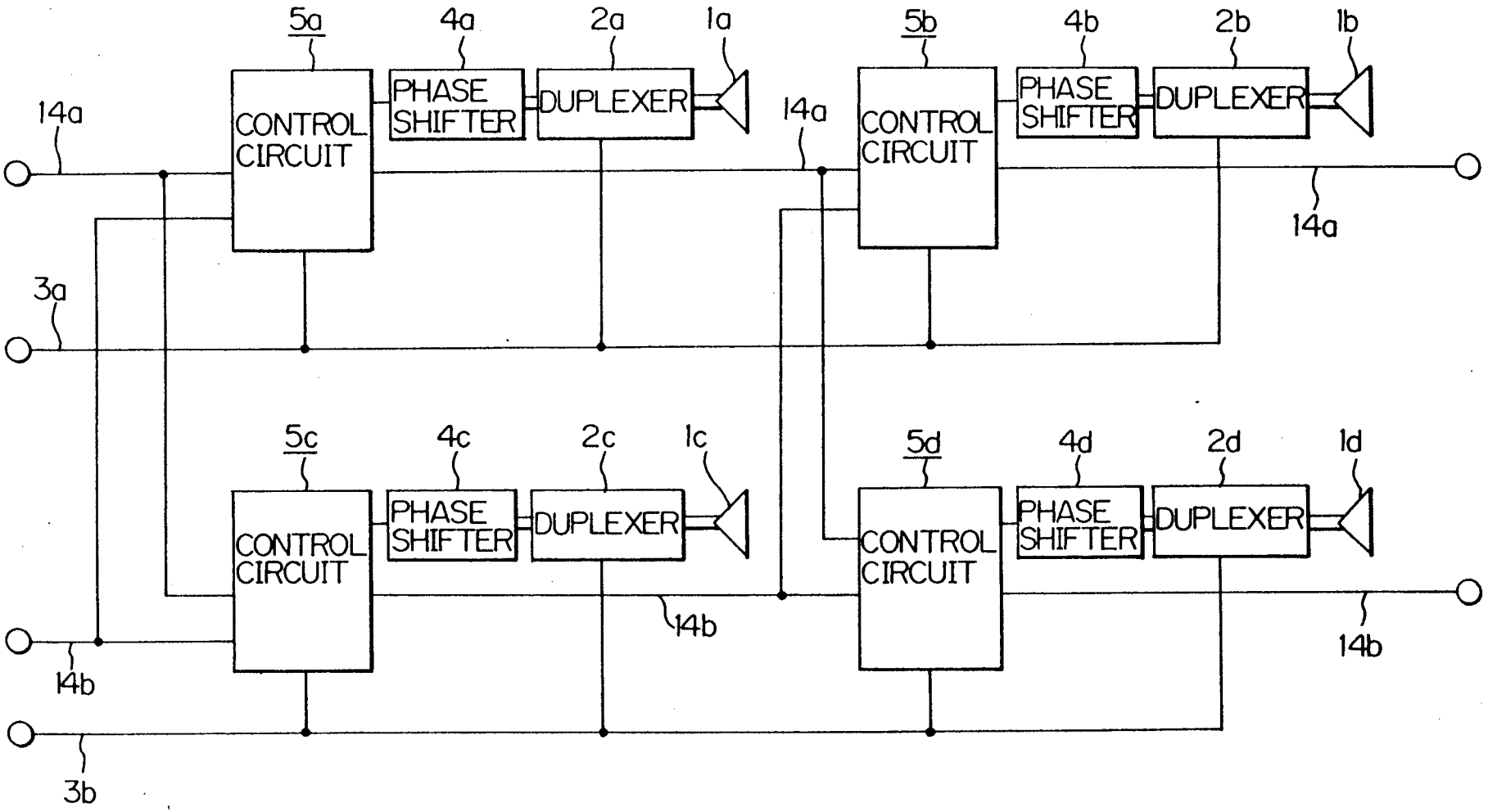
Figure 21:
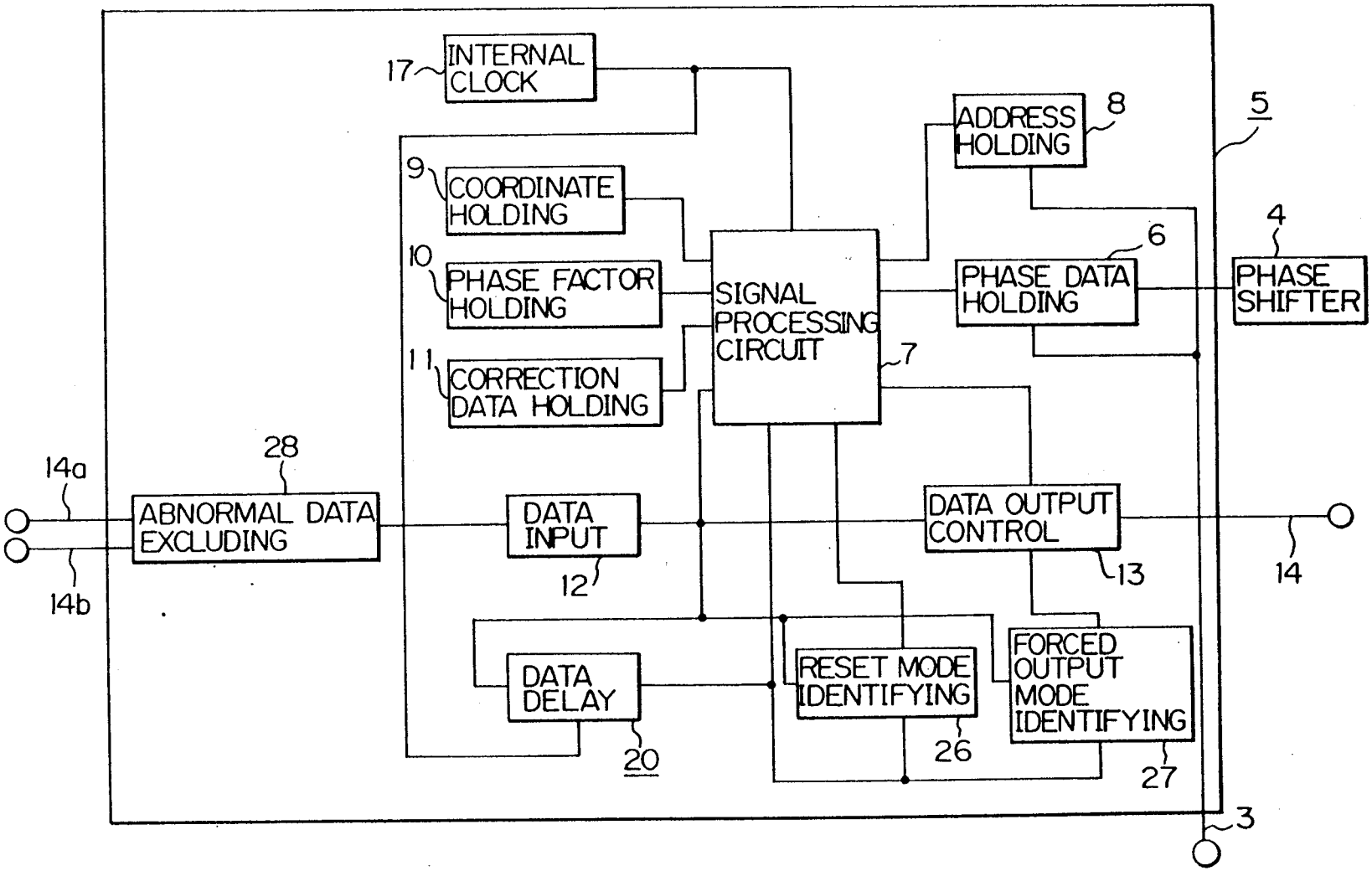

FIGS. 20 and 21 show a still further embodiment in which, as shown in FIG. 20, a plurality of phase shifter control circuits 5*a*–5*d* is arranged in plural systematic lines and the data lines 14*a*, 14*b* of the respective systematic lines are independently connected to the corresponding phase shifter control circuits 5*a*–5*d* by separate lines. At the same time, as shown in FIG. 21, each of the phase shifter control circuits 5*a*–5*d* is provided with an abnormal data excluding circuit 14*a*, 14*b* of the respective groups and transferring only a normal data to the data input circuit 12. In this embodiment, even when the data of the phase shifter control circuit in one of the groups becomes abnormal due to, for example, breakdown of the data lines, occurrence of short circuit to the ground, or the failure of the ahead phase shifter control circuit, the normal data is independently inputted from another group so that the normal data is not interfered with by the abnormal data. Further, since the abnormal data excluding circuit 28 only transmits the normal data to the data input circuit 12, spread of the abnormal data into the whole area of the antenna control data transfer system can be prevented even when an abnormal data is produced.

Although the above embodiments have been described as being provided with four antenna elements and four phase shifter control circuits, it should be noted that the number of those components is arbitrary and similar merits can be obtained in any case.

Although the addresses of the phase shifter control circuits 5*a*–5*d* have also been described as being Nos. 1 and 2, any other, but not overlapped numbers can be used with the same merits.

In the above embodiments, the leading edges of the clock portions of the data have been used, but the same merits can be obtained by using trailing edges.

Also, although the time ratio of the clock and data portions of the data was approximately 1:1, any other ratio may be available within the operable range.

Further, the delay time given by the data delay circuit 20 was selected so that the clock and data portions of the data substantially correspond to one another, but any desired delay time within the operable range can bring about the same effects.

Furthermore, the delay time of latch clock produced by the data delay circuit 20 was about a half of the period of the clock portion of the data, but any desired delay time within the operable range can bring about the same effects.

Although the plurality of the phase shifter control circuits 5*a*–5*d* were arranged in two systematic lines, any desired number of groups can be adopted for obtaining the same effects.

As described above, according to the present invention, each of the phase shifter control circuits are provided with an address holding circuit for holding an address for identifying the respective phase shifter control circuit, an input circuit for inputting data from the outside of a system and a data output control circuit for controlling either outputting the data or inhibiting the data from being outputted in accordance with the data output control signal from the signal processing circuit, the data output side of the data input circuit and the data input side of the data output control circuit being directly connected to each other, and the plurality of phase shifter control circuits being connected in a cascade fashion through a data line (that is, the output of a phase shifter control circuit is connected to the input of a subsequent phase shifter control circuit), whereby the processing in the signal processing circuit is performed when the address held in the address holding circuit of the respective phase shifter control circuits coincides with the address attached to the delivered data and thus the X-enable and Y-enable lines included in the conventional system can be eliminated. In addition, even if the number of the antenna elements is increased and the phase shifter control circuits increase in number the connections to the outside of the antenna control data transfer system are not increased but maintained at a fixed amount.

What is claimed is:

1. A system for transferring antenna control data via a data line and comprising a plurality of phase shifter controls circuits for controlling phase shifters which are capable of changing the phase of electromagnetic waves to be transmitted or received by antenna elements, wherein each of the phase shifter control circuits includes:

an address holding circuit for holding an address for identifying each phase shifter control circuit;

a data input circuit for inputting data from the input to data line;

a data output control circuit for outputting the inputted data or inhibiting the inputted data from being outputted in accordance with a data output control signal from a signal processing circuit which processes the inputted data;

the data output of said data input circuit being coupled to the data input side of said data output control circuit;

and means for sequentially coupling said plurality of phase shifter control circuits one after the other in the data line.

2. An antenna control data transfer system as set forth in claim 1 wherein each of said phase shifter control circuits is further provided therein with an internal clock generating circuit for generating an internal clock used with the phase shifter control circuit.

3. An antenna control data transfer system as set forth in claim 2 further comprising a clock input circuit for inputting clock from the outside of the system, and a clock output control circuit for outputting the inputted clock or inhibiting the inputted clock from being outputted in accordance with the data output control signal from said signal processing circuit.

4. An antenna control data transfer system as set forth in claim 2 further comprising a data delay circuit for delaying the propagation of the data inputted by said data input circuit, and the data itself including a data portion and a clock portion.

5. An antenna control data transfer system as set forth in claim 4 wherein said data delay circuit and said internal clock generating circuit are connected to each other, and said data delay circuit is provided therein with a clock portion detecting circuit for detecting the clock portion of the input data, a period counting circuit for detecting the period of the clock portion or data portion and a latch clock generating circuit for generating a latch clock having the function equivalent to the clock portion.

6. An antenna control data transfer system as set forth in claim 5 wherein each of the phase shifter control circuits further includes a reset mode indentifying circuit for identifying the reset mode on the basis of the data portion of the input data and the latch clock from said data delay circuit to reset said signal processing circuit and a forced output mode identifying circuit for identifying the forced output mode on the basis of the data portion of the input data and the latch clock from said data delay circuit to cause said data output control circuit to output the data.

7. An antenna control data transfer system as set forth in claim 6 further comprising a duplexer control signal line for supplying a duplexing signal for switching between the transmit and receive of the electromagnetic waves by the antenna elements, said duplexer control signal line being connected to a phase data holding circuit included in the phase shifter control circuit.

8. An antenna control data transfer system as set forth in claim 7 wherein said plurality of the phase shifter control circuits are connected in plural groups and the corresponding data lines of each of the groups are connected to one another.

9. An antenna control data transfer system as set forth in claim 8 wherein the duplexer control signal lines are independently provided for each of the groups and connected to the address holding circuit of each of the phase shifter control circuits.

10. An antenna control data transfer system as set forth in claim 7 wherein said plurality of the phase shifter control circuits are connected in plural groups and the corresponding phase shifter control circuits in each of the groups are connected to each other by the respective data lines, and each of the phase shifter control circuits is provided therein with an abnormal data excluding circuit for excluding any abnormal data from the data lines of the respective groups and transferring only a normal data to the data input circuit, and the duplexer control signal lines of the respective groups are independently connected to the address holding circuits within the respective phase shifter control circuits.

11. A system for distributing phase control information in an array of antenna elements with associated phase shifters, comprising:

a plurality of phase shifter control means, each comprising;

a data input means, comprising means for receiving data from outside the phase shifter control means and means for distributing that data within said phase shifter control means, an address holding means, comprising an address storage means and an address retrieval means, a data output control means, comprising means for selectively allowing or inhibiting the coupling of data out of said phase shifter control means, said data having been received from said data input means, and a signal processing means, comprising means for processing data received from said data input means, means for accessing said address holding means, and means for controlling said data output means based on information contained in said data and said address holding means, an external data input means, comprising means for receiving data from outside said system and means for coupling said data to said data input means of a first phase shifter control means;

and a plurality of data coupling means, comprising means for sequentially coupling said data from said data output control means of a phase shifter control means to said data input means of a next phase shifter control means, said data output control means of a last phase shifter control means being coupled out of said system.

12. An antenna phase control data distribution system as recited in claim 11, wherein:

each of said phase shifter control means further comprises an internal clock means.

13. An antenna phase control data distribution system as recited in claim 11, wherein:

each of said phase shifter control means further comprises;

a clock input means, comprising means for receiving a clock signal from outside said phase control means and means for distributing said clock signal within said phase shifter control means, and a clock output control means, comprising means for selectively allowing or inhibiting the coupling of said clock signal out of said phase shifter control means, said clock signal having been received from said clock input means, said antenna phase control data distribution system further comprising;

an external clock input means, comprising means for receiving a clock signal from outside said system and means for coupling said clock signal to said clock input means of a first phase shifter control means, and a plurality of clock signal coupling means, comprising means for sequentially coupling said clock signal from said clock output control means of a phase shifter control means to said clock input means of a next phase shifter control means, said clock output control means of a last phase shifter control means being coupled out of said system.

14. An antenna phase control data distribution system as recited in claim 11, wherein:

each of said phase shifter control means further comprises;

a data delay means, comprising means for receiving data from said data input means, means for delaying the propagation of said data, and means for distributing that data within the phase shifter control means.

15. An antenna phase control data distribution system as recited in claim 14 wherein:

said data comprises data information and clock information;

each of said data delay means further comprise;

means for detecting said clock information, and means for generating a latch clock signal from said detected clock information.

16. An antenna phase control data distribution system as recited in claim 11, wherein each of said phase shifter control means further comprises;

a reset mode identifying means, comprising means for identifying the reset mode command which may be conveyed within said data information, and a forced output mode identifying means, comprising means for identifying the forced output mode command which may be conveyed within said data information.

17. An antenna phase control data distribution system as recited in claim 11, wherein:

each of said data input means further comprises;

abnormal data excluding means, comprising means for detecting abnormal data, and means for inhibiting distribution of any data detected by said means to be abnormal.

18. An antenna phase control data distribution system as recited in claim 17, wherein:

said phase shifter control means are divided into a plurality of groups;

said external data input means comprises a plurality of means for receiving data from outside system and coupling said data to said data input means of a first phase shifter control means of each plural group of said phase shift control means; and a plurality of data coupling means, for sequentially coupling said data from said data output control means of a phase shifter control means to said data input means of a next phase shifter control means within each plural group, said data output control means of a last phase shifter control means of each plural group being coupled out of said system.

19. A system for distributing phase control information in association with an array of antenna elements, with each antenna element having an associated phase shifter, said system comprising:

a plurality of phase shifter control means;

means for establishing an input control data signal for coupling to a first one of said plurality of phase shifter control means;

means for sequentially coupling said plurality of phase shifter control means from said input establishing means in a series circuit;

each said phase shifter control means comprising;

a data input means for inputting data, a data output means, comprising means for selectively allowing or inhibiting the coupling of data out of said phase shifter control means, and a signal processing means comprising means for processing data received from said data input means and including means for controlling said data output means based at least on information contained in said data input means.

20. A system as recited in claim 19, wherein each of said phase shifter control means further comprises an address holding means.

21. A system as recited in claim 19, wherein each of said phase shifter control means further comprises an internal clock means.

22. A system as recited in claim 19, further comprising;

means for establishing an input clock signal for coupling to a first one of said plurality of phase shifter control means, means for sequentially coupling said plurality of phase shifter control means from said clock establishing means in a series circuit, each of said phase shifter control means further comprises;

a clock input means for inputting a clock signal, and a clock output control means, for selectively allowing or inhibiting the coupling of the clock out of said phase shifter control means.

23. A system as recited in claim 19, wherein each of said phase shifter control means further comprises;

a data delay means, comprising means for receiving data from the data input means, and means for delaying the propagation of said data.

24. A system as recited in claim 23, wherein:

said data comprises data information and clock information;

each of said data delay means further comprises;

means for detecting said clock information, and means for generating a latch clock signal from said detected clock information.

25. A system as recited in claim 19, wherein:

each of said phase shifter control means further comprises;

a reset mode identifying means, and a forced output mode identifying means.

26. A system as recited in claim 19, wherein each of said data input means further comprises abnormal data excluding means.

27. A system as recited in claim 26, wherein:

said phase shifter control means are divided into a plurality of groups;

said input establishing means comprises multiple means for coupling multiple input control data signals to said data input means of each first one of said plurality of groups;

and each said sequential coupling means comprises multiple means for coupling said plurality of phase shifter control means within each group to said input establishing means in a series circuit within said group.

* * * * *